US007571909B2

(12) United States Patent
Saeki et al.

(10) Patent No.: US 7,571,909 B2
(45) Date of Patent: Aug. 11, 2009

(54) SHEET TREATING APPARATUS AND IMAGE FORMING APPARATUS PROVIDED THEREWITH

(75) Inventors: Naoto Saeki, Abiko (JP); Hiroshi Suzuki, Toride (JP); Atsushi Takada, Toride (JP); Akihito Nagayama, Tokyo (JP)

(73) Assignee: Canon Finetech Inc., Mitsukaido-Shi (JP)

( * ) Notice: Subject to any disclaimer, the term of this patent is extended or adjusted under 35 U.S.C. 154(b) by 543 days.

(21) Appl. No.: 11/106,637

(22) Filed: Apr. 15, 2005

(65) Prior Publication Data

US 2005/0236764 A1 Oct. 27, 2005

(30) Foreign Application Priority Data

Apr. 19, 2004 (JP) ..... 2004-123556
Apr. 19, 2004 (JP) ..... 2004-123557
Apr. 19, 2004 (JP) ..... 2004-123558
Apr. 19, 2004 (JP) ..... 2004-123559

(51) Int. Cl.
*B65H 39/10* (2006.01)
*B65H 33/04* (2006.01)
*B65H 39/00* (2006.01)

(52) U.S. Cl. ..... 271/292; 271/293; 271/220; 271/287; 270/58.14; 270/58.15; 270/58.18; 270/58.19; 270/58.28; 399/403

(58) Field of Classification Search ..... 271/293, 271/292, 298, 213, 294; 399/107, 404, 403, 399/405

See application file for complete search history.

(56) References Cited

U.S. PATENT DOCUMENTS 4,466,608 A 8/1984 DuBois et al.
4,621,803 A * 11/1986 Johdai et al. ..... 271/293
4,738,443 A * 4/1988 Honjo et al. ..... 271/288
5,084,736 A 1/1992 Suzuki et al.
5,087,029 A * 2/1992 Sugishima ..... 271/293
5,168,290 A 12/1992 Tanaka et al.
5,201,873 A 4/1993 Kikuchi et al.
5,239,347 A 8/1993 Onodera et al.

(Continued)

FOREIGN PATENT DOCUMENTS

EP 1 078 873 A1 2/2001

(Continued)

OTHER PUBLICATIONS

European Search Report, issued by the European Patent Office, in European Patent Application No. 05007940, 2005.

(Continued)

*Primary Examiner*—Patrick H Mackey
*Assistant Examiner*—Patrick Cicchino
(74) *Attorney, Agent, or Firm*—Fitzpatrick, Cella, Harper & Scinto

(57) ABSTRACT

The invention is to provide a sheet treating apparatus achieving a space saving and enabling easy identification of an output mode of sheets. The sheet treating apparatus of the invention for treating sheets after image formation is accommodated in a space formed in an image forming apparatus, and includes plural sheet stacking devices which stack treated sheets, and a lifting and lowering device which independently lifts and lowers the plural sheet stacking devices.

20 Claims, 21 Drawing Sheets

U.S. PATENT DOCUMENTS

| | | | | |
|---|---|---|---|---|
| 5,321,486 | A | 6/1994 | Nanbu et al. | |
| 5,377,972 | A * | 1/1995 | Sugishima et al. | 271/293 |
| 5,543,908 | A | 8/1996 | Suzuki | |
| 5,555,082 | A | 9/1996 | Tanaka et al. | |
| 5,676,363 | A | 10/1997 | Kishida et al. | |
| 5,738,453 | A | 4/1998 | Tsuburaya et al. | |
| 5,742,890 | A | 4/1998 | Kato et al. | |
| 5,992,838 | A | 11/1999 | Saitoh | |
| 6,146,085 | A * | 11/2000 | Namba et al. | 414/789.9 |
| 6,231,045 | B1 | 5/2001 | Yamada et al. | |
| 6,273,418 | B1 | 8/2001 | Fujikura et al. | 271/228 |
| 6,322,070 | B2 | 11/2001 | Yamada et al. | |
| 6,390,466 | B1 * | 5/2002 | Sanmiya | 271/213 |
| 6,412,994 | B1 | 7/2002 | Collard | 400/624 |
| 6,416,052 | B2 | 7/2002 | Yamada et al. | |
| 6,473,590 | B2 * | 10/2002 | Matsumoto et al. | 399/404 |
| 6,542,715 | B2 * | 4/2003 | Miyamoto et al. | 399/405 |
| 6,631,896 | B2 * | 10/2003 | Yamada et al. | 270/58.09 |
| 6,671,491 | B1 * | 12/2003 | Yamanaka et al. | 399/407 |
| 6,705,603 | B1 * | 3/2004 | Kirino et al. | 270/12 |
| 6,782,216 | B2 | 8/2004 | Suzuki | |
| 2001/0005067 | A1 | 6/2001 | Yamada et al. | |
| 2002/0000692 | A1 | 1/2002 | Yamada et al. | |
| 2002/0131787 | A1 * | 9/2002 | Shimizu et al. | 399/82 |
| 2002/0180144 | A1 | 12/2002 | Yamada et al. | |
| 2002/0195768 | A1 * | 12/2002 | Yamakawa et al. | 271/213 |
| 2004/0051238 | A1 | 3/2004 | Yamada et al. | |
| 2004/0173960 | A1 | 9/2004 | Oikawa et al. | |
| 2004/0174552 | A1 * | 9/2004 | Miyake et al. | 358/1.12 |
| 2004/0251621 | A1 * | 12/2004 | Suzuki et al. | 271/298 |
| 2006/0051147 | A1 * | 3/2006 | Sato et al. | 399/405 |
| 2006/0202412 | A1 * | 9/2006 | Matsue et al. | 271/292 |

FOREIGN PATENT DOCUMENTS

| | | |
|---|---|---|
| JP | 2000-272806 | 10/2000 |
| JP | 2001-72311 | 3/2001 |

OTHER PUBLICATIONS

Official Letter/Search Report, issued by The Patent Office of the People's Republic of China, on Apr. 25, 2008, in Chinese Application No. 200510065280.5, with translation.

* cited by examiner

SHEET TREATING APPARATUS AND IMAGE FORMING APPARATUS PROVIDED THEREWITH

BACKGROUND OF THE INVENTION

1. Field of the Invention

The present invention relates to a sheet treating apparatus and an image forming apparatus provided therewith.

2. Related Background Art

In an image forming apparatus such as a copying apparatus, a printer, a facsimile or a multi-functional composite equipment thereof, there is known an apparatus in which a main body of the image forming apparatus is provided with a sheet treating apparatus for applying a treatment such as a stapling onto a sheet discharged from such main body after an image formation.

Such sheet treating apparatus conveys sheets discharged from the main body of the image forming apparatus to a sheet treating portion, then executing a sheet stack aligning operation for stacking and aligning such discharged sheets and a treatment such as a stapling operation for stapling the sheets, and, after such treatments, discharging sheets or a stack of sheets (hereinafter called sheet stack (bundle)) to a stack tray (sheet stacking device).

Also the sheet treating apparatus is generally provided at a lateral side of the main body of the image forming apparatus, but there is known a configuration in which a main body of the sheet treating apparatus is positioned above an image forming portion so as not to exceed the area of the image forming apparatus, thereby achieving a space saving (for example cf. Japanese Patent Application Laid-Open No. 2001-72311).

However, as such prior sheet treating apparatus is provided with only one stacking tray, in case such sheet treating apparatus is accommodated in a recent composite printer having various modes (functions) such as a copying machine, a printer, a facsimile and the like, the sheets outputted in correspondence with (or in association with) the modes of copying, printing, facsimile and the like are discharged and stacked on a same stacking tray.

When the sheets outputted in correspondence with various modes are stacked on a same stacking tray, it becomes difficult to identify (distinguish) that the stacked sheets were respectively outputted in which modes, so that the needs of the users cannot be satisfied.

SUMMARY OF THE INVENTION

The present invention has been made in consideration of such situation, and an object thereof is to provide a sheet treating apparatus capable of space saving and allowing to easily distinguish the sheet was outputted in correspondence with which mode, and an image forming apparatus equipped with such sheet treating apparatus.

The aforementioned object can be attained, according to the present invention, by a sheet treating apparatus for treating sheets after image formation:

adapted to be accommodated in a space formed in an image forming apparatus; and including plural sheet stacking devices which stack treated plural sheets; and a lifting and lowering device which independently lifts and lowers the plural sheet stacking devices.

The present invention is also characterized in, including a sheet treating portion for treating sheets after image formation, and a discharge device which discharges the sheets treated by the sheet treating portion, and in that the sheets treated by the sheet treating portion are selectively stacked by the discharge device on the plural sheet stacking devices.

In the present invention, by providing the sheet treating apparatus accommodated in the space formed in the image forming apparatus with plural sheet stacking devices capable of lifting and lowering independently, and by selectively stacking sheets on these plural sheet stacking devices, it is rendered possible to achieve a space saving and to easily distinguish the sheet was outputted in correspondence with which mode. It is also rendered possible to achieve a classified stacking according to the modes such as copying, printing, facsimile and the like, and to provide an apparatus optimum for the needs of the offices.

When plural sheet stacking devices are provided in a state capable of lifting and lowering independently, in case an extraneous substance is present or a large amount of sheets are stacked on the uppermost sheet stacking device, such extraneous substance or such sheets may abut on an upper face of the accommodating space in the image forming apparatus before the uppermost stacking device is detected by an upper limit sensor. Also in case the sheet stacking device continues to be lifted even after the extraneous substance or the sheets abut on the upper face of the accommodating space in the image forming apparatus, there may result a breakage in the extraneous substance, the sheets or the sheet stacking device.

Thus, another aspect of the invention is to provide a sheet treating apparatus capable of achieving a space saving and also preventing a breakage in the sheet stacking device or in the sheets stacked on the sheet stacking device, and an image forming apparatus equipped with such sheet treating apparatus.

In such another aspect of the invention, there is provided a sheet treating apparatus for treating sheets after image formation:

adapted to be accommodated in a space formed in an image forming apparatus; and including plural sheet stacking devices which stack treated plural sheets;

a lifting and lowering device which independently lifts and lowers the plural sheet stacking devices; and a limiting device which limits lifting of the sheet stacking device.

Also in another aspect of the invention, the limiting device may be provided in at least an uppermost sheet stacking device among the plural sheet stacking devices.

Also in another aspect of the invention, the limiting device may be so constructed as not to transmit a driving power of the lifting and lowering device to the sheet stacking device, in case a torque in lifting the sheet stacking device exceeds a predetermined torque.

In such another aspect of the invention, by providing the sheet treating apparatus accommodated in the space formed in the image forming apparatus with plural sheet stacking devices capable of lifting and lowering independently, by providing a limiting device which limits lifting of the sheet stacking device, and by limiting lifting of the sheet stacking device by such limiting device, it is rendered possible to achieve a space saving and to prevent a breakage in the sheet stacking device or in the sheets stacked on the sheet stacking device. It is also rendered possible to achieve a classified stacking according to the modes such as copying, printing, facsimile and the like, and to provide an apparatus optimum for the needs of the offices.

In the aforementioned prior sheet treating apparatus, a stacking tray for stacking treated sheets (stack) is provided under a sheet discharge port, so that a sheet stacking amount of the stacking tray is limited according to a distance from the stacking tray to the sheet discharge port, and the sheet stacking amount becomes smaller in case such distance is short.

In case such sheet treating apparatus is incorporated in a recent composite printer having various modes (functions) such as a copying machine, a printer, a facsimile and the like, and in case the sheet stacking amount is limited and sheets are outputted in correspondence with the modes of copying, printing, facsimile and the like, the sheets may soon reach and block the sheet discharge port.

In consideration of such situation, a further aspect of the invention is to provide a sheet treating apparatus capable of achieving a space saving and stacking a large amount of sheets, and an image forming apparatus equipped with such sheet treating apparatus.

In such further aspect of the invention, there is provided a sheet treating apparatus for treating sheets after image formation:

adapted to be accommodated in a space formed in an image forming apparatus; and including a discharging device which discharges treated sheets;

sheet stacking devices which stack sheets discharged from the discharge device; and a lifting and lowering device which independently lifts and lowers the sheet stacking devices;

wherein the lifting and lowering device moves the sheet stacking device above a sheet discharge port for discharging the sheets by the discharge device.

Also in further aspect of the invention, a space for moving the sheet stacking device may be provided above the sheet discharge port.

In such further aspect of the invention, by providing the sheet treating apparatus accommodated in the space formed in the image forming apparatus with plural sheet stacking devices capable of lifting and lowering independently, and by moving the sheet stacking device above the sheet discharge port, it is rendered possible to achieve a space saving and to stack a large amount of sheets. It is also rendered possible to discharge and stack a large amount of sheets corresponding to the modes such as copying, printing, facsimile and the like, and to provide an apparatus optimum for the needs of the offices.

Further, in case the sheet treating apparatus is provided, for the purpose of being accommodated in a recent composite printer having various modes (functions) such as a copying machine, a printer, a facsimile and the like, with plural sheet discharge ports in plural vertical positions corresponding to the modes of copying, printing, facsimile and the like, the sheet treating apparatus becomes larger in the height. Also in case such sheet treating apparatus is positioned above the image forming portion, the composite printer may become bulky.

In consideration of such situation, a further aspect of the invention is to provide a sheet treating apparatus capable of achieving a space saving and suppressing a height dimension, and an image forming apparatus equipped with such sheet treating apparatus.

In such further aspect of the invention, there is provided a sheet treating apparatus for treating sheets after image formation:

adapted to be accommodated in a space formed in an image forming apparatus; and including a discharging device which discharges treated sheets;

plural sheet stacking device which stack sheets discharged from the discharge device;

a lifting and lowering device which independently lifts and lowers the sheet stacking devices; and a common sheet discharge port for discharging sheets by the discharge device;

wherein the discharge device discharges the sheets from the common discharge ports selectively to the sheet stacking devices.

Also in such further aspect of the invention, the common sheet discharge port may be provided at an approximate center in a direction of height of a sheet stacking space in which the plural sheet stacking devices are vertically movably provided.

In such further aspect of the invention, by providing the sheet treating apparatus accommodated in the space formed in the image forming apparatus with a common sheet discharge port and with plural sheet stacking devices capable of lifting and lowering independently, and by selectively discharging the sheets from the common sheet discharge port to the plural sheet stacking devices, it is rendered possible to achieve a space saving and to limit the dimension in height.

In such further aspect of the invention, the sheet stacking device may be so constructed as to have a substantially horizontal sheet stacking surface. Also the sheet stacking device may be provided with a sheet pressing device which presses the sheets stacked on the sheet stacking device.

In such configuration, the sheet stacking device having the substantially horizontal surface enables an effective utilization of a narrow space. Also the sheet pressing device allows to maintain stacking and aligning property effectively even with a substantially horizontal surface in the sheet stacking device.

These and other objects, features and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

In the following, preferred embodiments of the present invention will be explained with referenced to the accompanying drawings.

Figure 1:
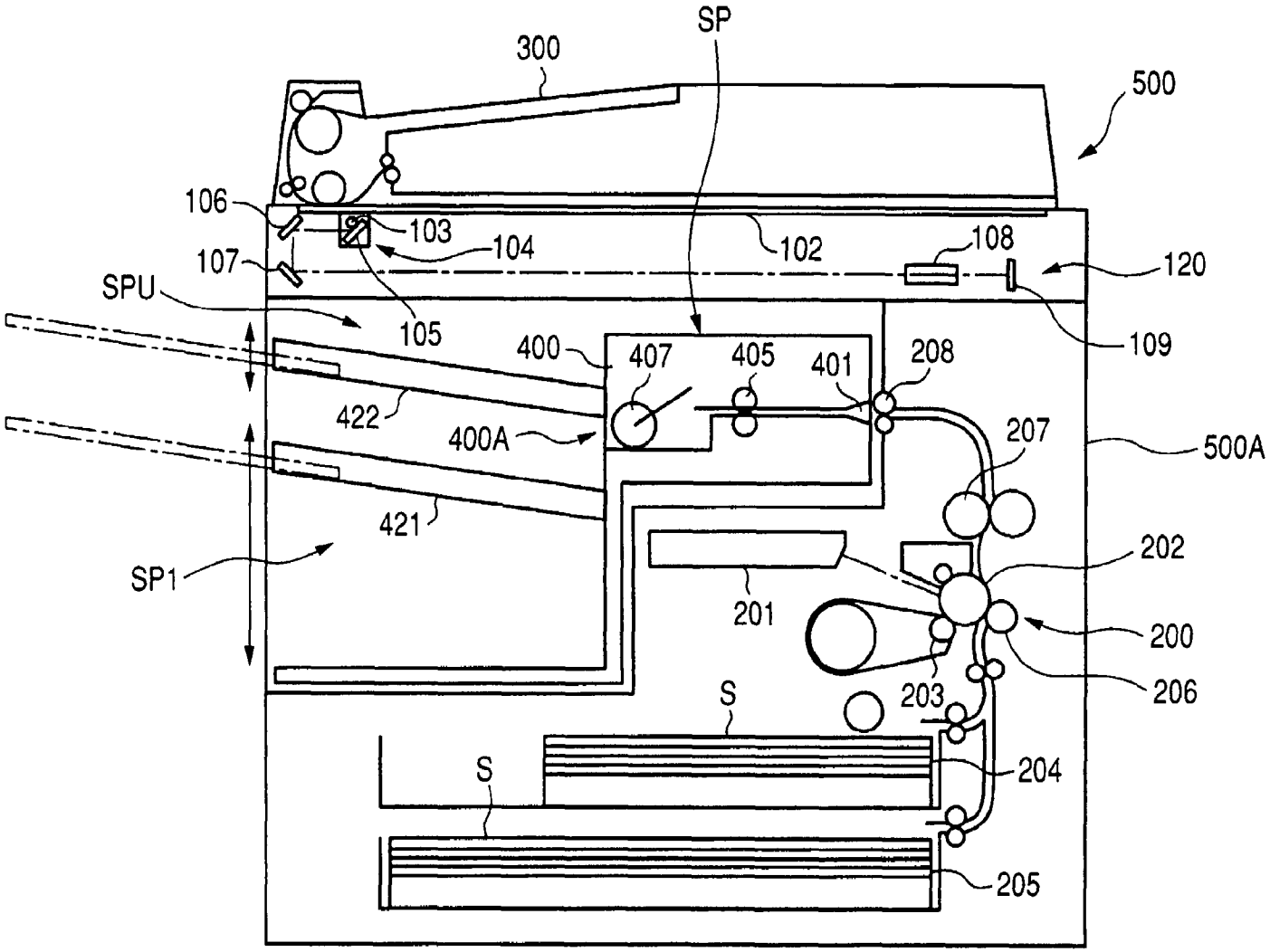
FIG. 1 is a cross-sectional view showing a configuration of an image forming apparatus equipped with a sheet treating apparatus embodying the present invention.

FIG. 1 is a cross-sectional view showing a configuration of an image forming apparatus provided with a sheet treating apparatus embodying the present invention, wherein shown are an image forming apparatus 500, a main body 500A of the image forming apparatus, a reader portion (image input apparatus) 120 provided on an upper face of the main body 500A of the image forming apparatus for reading an original image for conversion into image data, an automatic document feeder (ADF) 300 provided on an upper face of the reader portion 120, a sheet treating apparatus 400 for treating sheets discharged from the main body 500A of the image forming apparatus after an image formation therein, and a printer portion 200 having plural sheet cassettes 204, 205 and outputting image data as a visible image on a sheet in response to a print instruction.

In case of forming an image by reading an original image in the image forming apparatus 500 of the aforementioned configuration, at first unillustrated originals stacked on the automatic document feeder (ADF) 300 are conveyed one by one onto a platen glass 102 of the reader portion.

Then, when an original is conveyed to a predetermined position on the platen glass 102, a lamp 103 of the reader portion 120 is turned on and a scanner unit 104 is moved to irradiate the original. A light reflected from the original is transmitted through mirrors 105, 106, 107 and a lens 108 to a CCD image sensor 109, which executes an electrical process such as photoelectric conversion and an ordinary digital process.

Then the image signal thus electrically processed is converted in an exposure control portion 201 of the printer portion 200 into a modulated light signal which irradiates a photosensitive drum 202. Such irradiating light forms, on the photosensitive drum 202, a latent image which is developed with a developing device 203 to form a toner image on the photosensitive drum 202.

Then a sheet S is conveyed from the sheet cassette 204 or 205 in synchronization with a front end of the toner image, and the toner image is transferred onto the sheet S in a transfer portion 206. The toner image transferred onto the sheet S is fixed in a fixing portion 207, and the sheet S is thereafter discharged from a sheet discharge portion 208.

Then the sheet S, completing the image formation and discharged from the sheet discharge portion 208, is conveyed to the sheet treating apparatus 400 and is subjected therein to a treating such as a sorting or a stapling according to an operation mode designated in advance, and is stacked on a desired tray (stacking tray 421 or stacking tray 422).

In the following, there will be given an explanation on the sheet treating apparatus 400.

Figure 2:
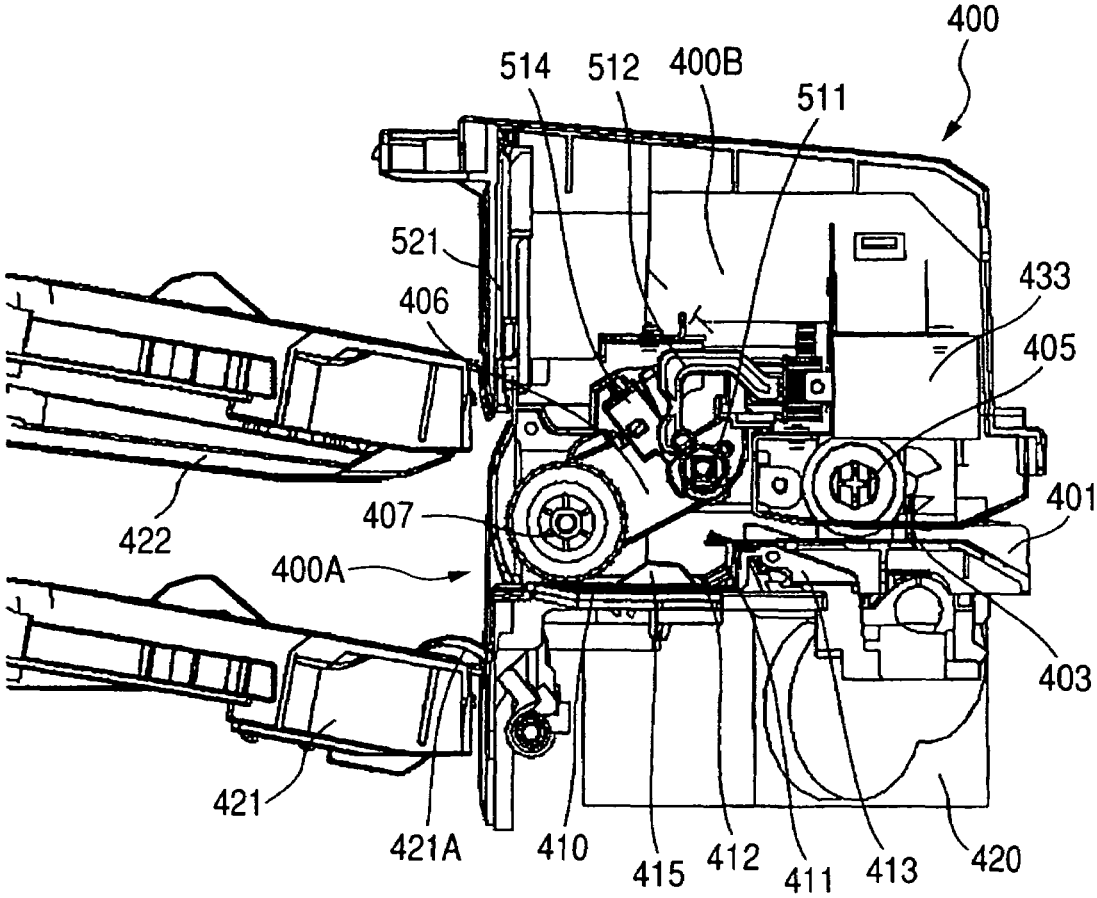
FIG. 2 is a view showing the configuration of the sheet treating apparatus.
Figure 4:
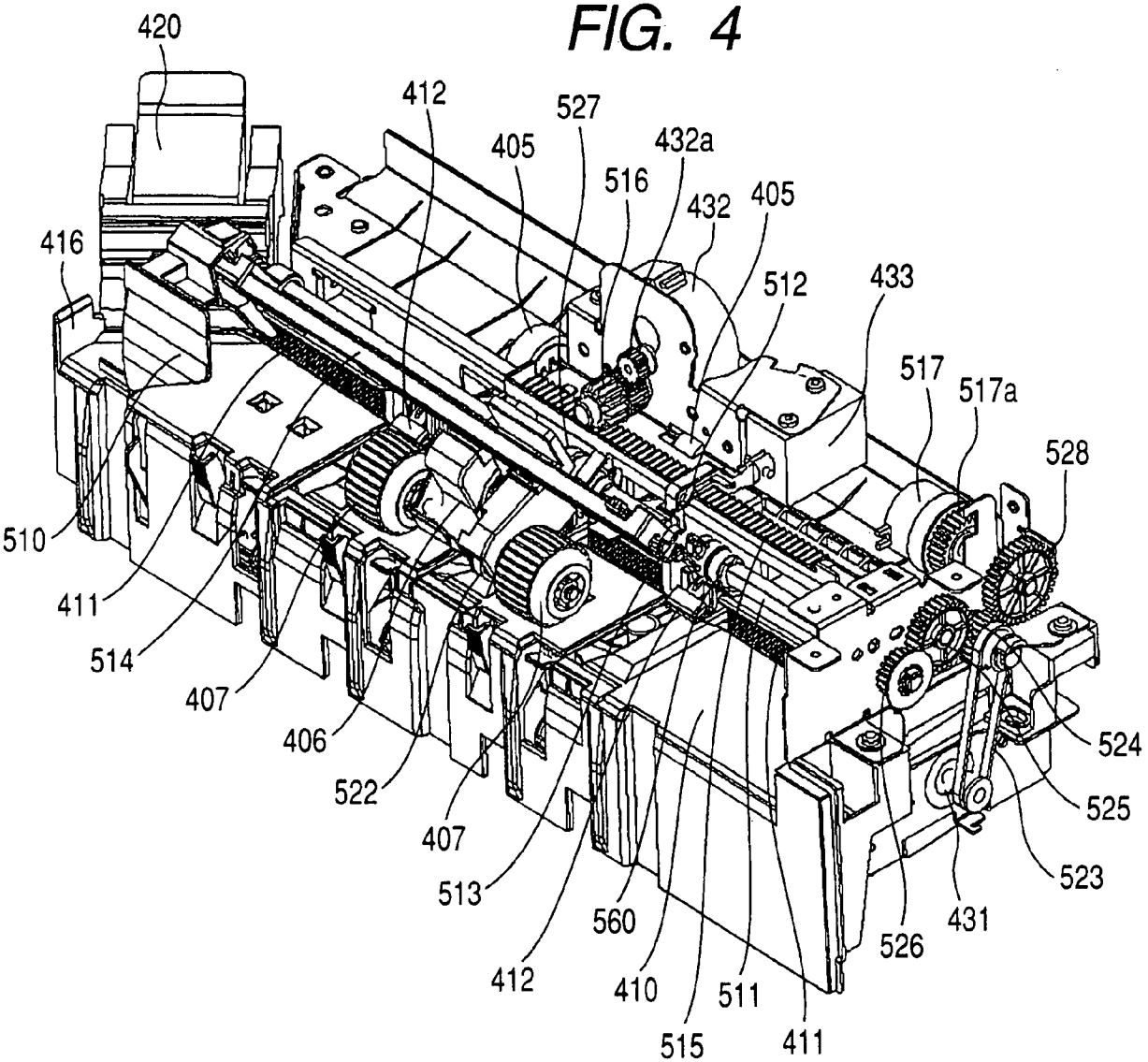
FIG. 4 is a view showing a drive mechanism for an offset roller and a conveying roller of the sheet treating apparatus.

The sheet treating apparatus 400 is, as shown in FIG. 1, accommodated within a space SP formed in a lateral portion of the main body 500A of the image forming apparatus without protruding from the main body 500A, and is provided, in addition to a sorting operation for sorting the sheets, with a stapling function for executing a stapling operation for example by a stapler unit 420 shown in FIG. 4. It is provided, as shown in FIG. 2, with a treating tray 410 for treating sheets S discharged in succession from the main body 500A of the image forming apparatus, a stacking tray (lower bin) 421 and a stacking tray (upper bin) 422 for finally stacking a sheet stack treated on the treating tray 410, and is so constructed and controlled as to form a stack of sheets of a number, corresponding to the number of the originals, on the treating tray 421 and to discharge and stack each sheet stack on the stacking tray (lower bin) 421 or the stacking tray (upper bin) 422.

Such configuration and control are enabled by a fact that plural (two in the present embodiment) stacking trays 421, 422 can be independently lifted and lowered, thus providing a novel configuration. Also such configuration and control enable classified stacking on the stacking trays 421, 422 in output operations not only in a copy job but also in an output job distant from the image forming apparatus such as in a printing job or a facsimile job, thereby contributing to the needs of the user.

In the example shown in FIG. 1, the reader portion and the automatic document feeder (ADF) are provided on the main body of the image forming apparatus, but, in case such constituents are absent, the sheet treating apparatus 400 can naturally be positioned on the image forming apparatus (or printer portion). In this manner a space saving can naturally be attained.

In the following, a structure of the sheet treating apparatus 400 will be explained.

Figure 3:
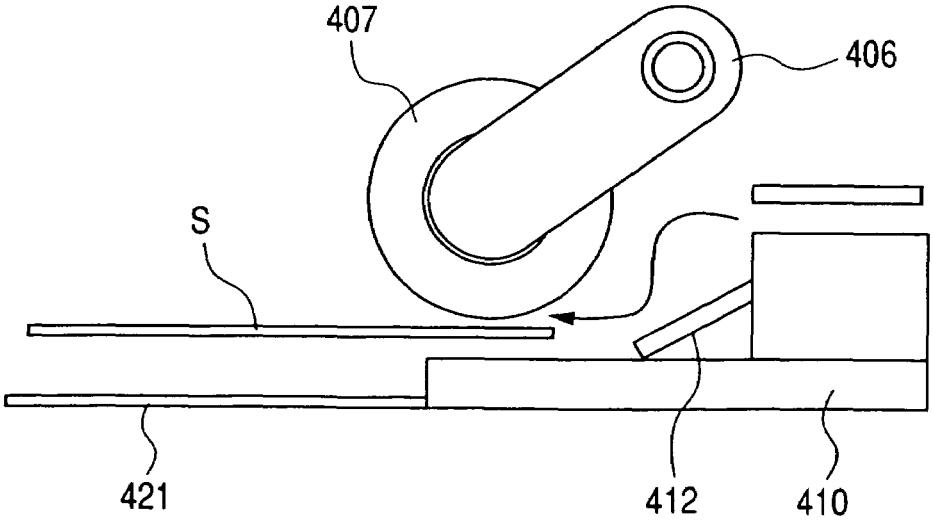
FIG. 3 is a view showing a state of a sheet discharge on a treating tray of the sheet treating apparatus.

Referring to FIG. 2, a sheet receiving portion 401 receives a sheet S discharged from the main body. 500A of the image forming apparatus, and the sheet S received by the sheet receiving portion 401 is, after being detected by an entrance sensor 403, conveyed by a conveying roller 405 and an offset roller 407, and is conveyed, as shown in FIG. 3, onto a treating tray 410 constituting treated sheet stacking device and provided in a sheet treating portion 400B for sheet treating. The sheet S thus stacked on the treating tray 410 is detected by a sheet stack discharge sensor 415.

The offset roller 407, constituted of a cylindrical member and serving as sheet conveying device, of which an external peripheral portion is constituted of an elastic member having a rubber-like elasticity such as rubber or a foamed member, and such offset roller 407 is supported by an offset roller holder 406 so as to be vertically movable about an offset shaft 511 shown in FIG. 4.

The offset roller holder 406 is rendered movable upward or downward by a pickup solenoid 433 about the offset shaft 511 as a fulcrum. More specifically, the offset roller 407 can be lifted or lowered by an on/off operation of the pickup solenoid 433 through a solenoid arm 512, a lever holder 513, a separating lever 514 and an offset roller holder 406.

When the sheet S is conveyed to the treating tray 410, the pickup solenoid 433 serving as position control device is turned on to move the offset roller 407 to an upper position not hindering the conveying of the sheet S, through the solenoid arm 512, the lever holder 513, the separating lever 514 and the offset roller holder 406, whereby the sheet S can be conveyed onto the treating tray 410 without being hindered by the offset roller 407.

Also the offset roller 407 is driven by a conveying motor 431, capable of forward or reverse rotations for driving a conveying roller 405 as shown in FIG. 4, through a timing belt 523, a roller gear 524, an idler gear 525, an offset gear 526, an offset pulley 527 and a timing belt 522, and is rotated, by a rotation of the conveying motor 431, in a conveying direction (hereinafter called forward rotation) or in a direction opposite to the conveying direction (reverse rotation), by an amount corresponding to a rotation amount of the conveying motor 431.

In the present embodiment, the entrance sensor 403 shown in FIG. 2 detects the conveyed sheet, and the pickup solenoid 433 is turned off when the sheet is conveyed by a predetermined distance by the conveying roller 405, whereupon the offset roller 407 descends by a weight thereof to land (abut) on the sheet while rotating in the sheet conveying direction, then conveys the sheet for a predetermined time, and rotates in the reverse direction further after a predetermined time.

Such reverse rotation causes a rear end of the sheet to abut on a sheet rear end stopper 411, provided standing on an upstream end of the treating tray 410 in the conveying direction and serving as a limiting member for limiting the position of the sheet S in the sheet conveying direction, thereby aligning the sheet S in the conveying direction.

In FIG. 4, there are shown a positioning wall 416 constituting a lateral end limiting member for limiting an end position of the sheet in a direction perpendicular to the sheet conveying direction (hereinafter called with direction), and a stapler unit 420 positioned in the vicinity of the positioning wall of the treating tray 410 and constituting binding device which executes a stapling treatment on a sheet stack formed on the treating tray 410. The offset roller 407 is rendered movable in the width direction and approachable to the positioning wall 416, by a drive of an offset motor 432 capable of forward or reverse rotation and constituting movement device in cooperation with the offset roller 407, through an offset motor gear 432*a*, an offset pinion 516 and an offset track 515.

When the offset roller 407 approaches the positioning wall 416, the sheet aligned in the conveying direction by abutting on the sheet rear end stopper 411 is conveyed toward the positioning wall 416 by a frictional force of the offset roller 407, and abuts on the positioning wall 416 at a sheet end under a curl correction by a sheet pressing member 510, thereby being positioned in the width direction. After the sheet S abuts on the positioning wall 416, the offset roller 407 moves, sliding on the sheet, by a predetermined amount toward the positioning wall 416 and is then stopped.

Figure 5A:
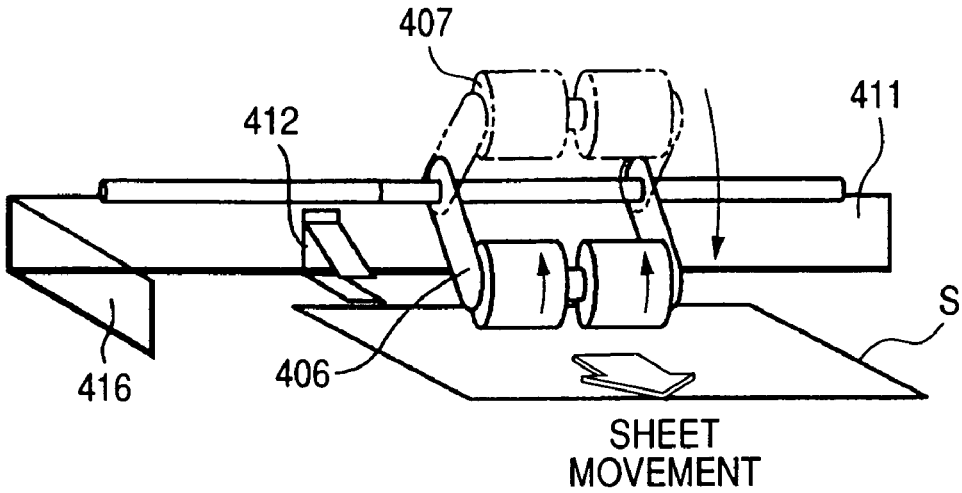
FIGS. 5A, 5B and 5C are views showing a function of the offset roller and a sheet movement associated therewith.

By the presence of such offset roller 407, the sheet discharged on the treating tray 410 is conveyed, as shown in FIG. 5A, toward the stacking tray by the offset roller 407 rotating in the sheet conveying direction, then is returned until the sheet rear end stopper 411 by a reverse rotation of the offset roller 407 as shown in FIG. 4B, and is aligned by an abutment of the rear end on the rear end stopper 411.

Figure 5B:
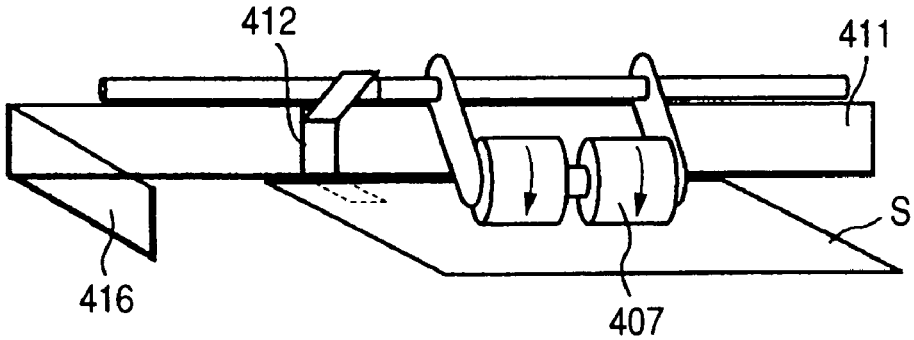
Figure 5C:
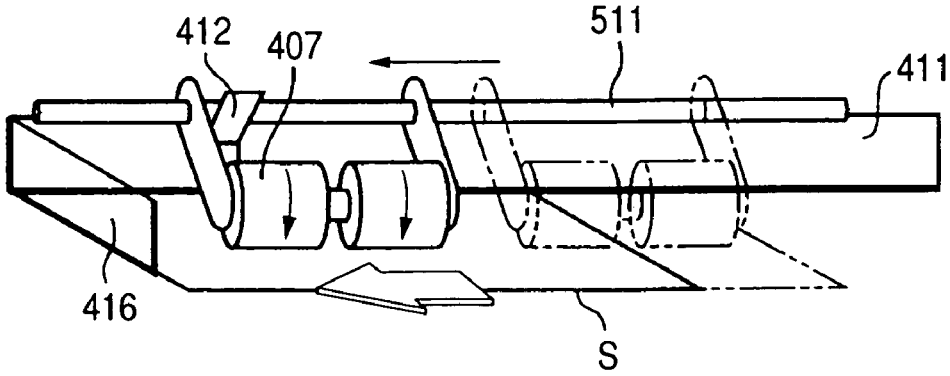

In FIGS. 5A to 5C and in FIGS. 6A, 6B, 7A, 7B and 22 to be explained later, there is explained a configuration in which, different from that in FIG. 4, the offset roller 407 is provided inside the offset roller holder 406, but such difference is merely a difference in designing and such configuration is not different in functions from that shown in FIG. 4.

Thereafter, the offset roller 407 is moved, as shown in FIG. 5C, in a state in contact with the sheet S, toward the positioning wall 416 along the offset shaft 511, whereby an end of the sheet S in the width direction is caused to abut on the positioning wall 416 and the sheet S is aligned in the width direction.

Figure 6A:
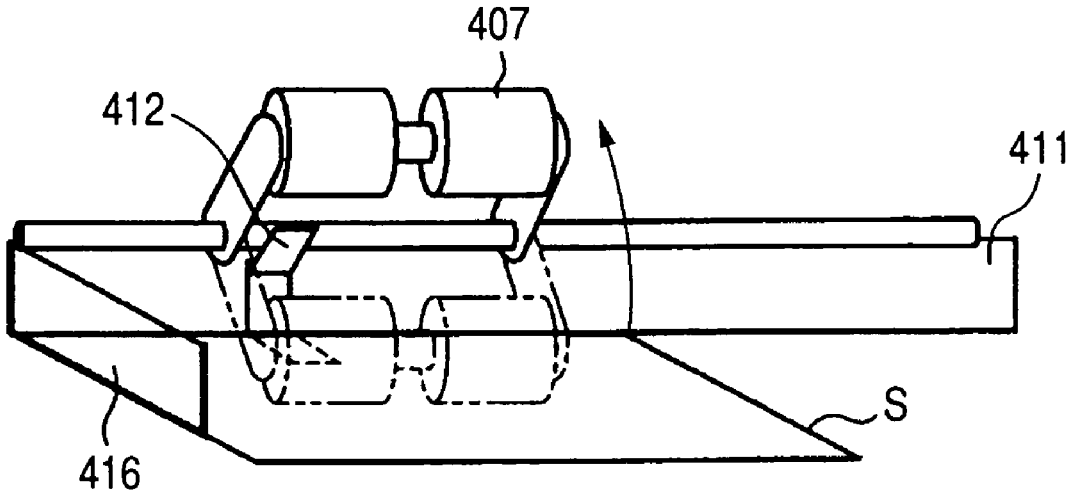
FIGS. 6A and 6B are first views showing a function of a sheet clamping member.
Figure 6B:
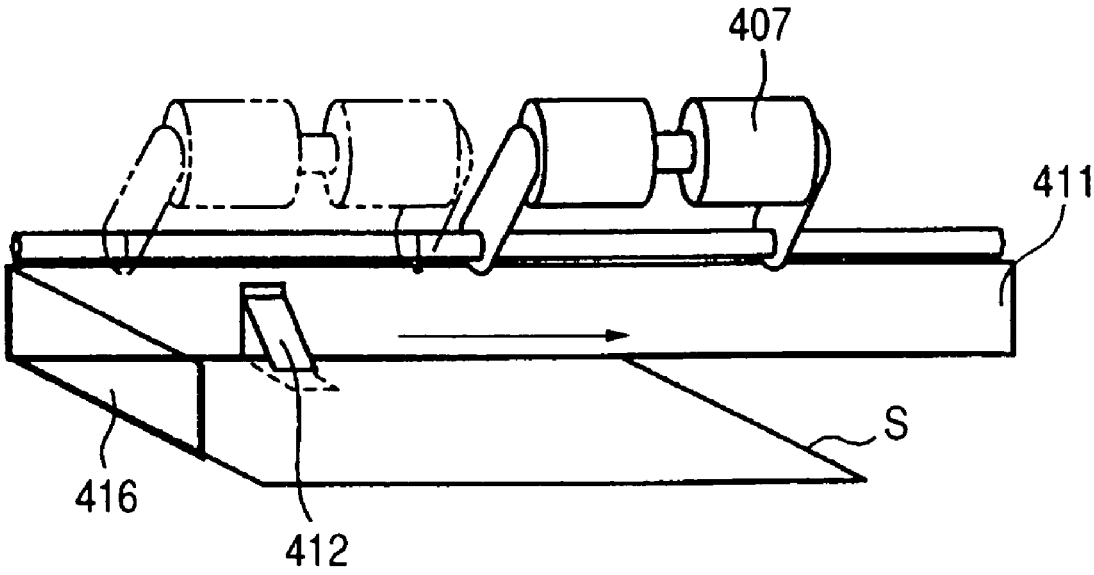

On the other hand, referring to FIG. 4, a sheet clamping member 412 serves as sheet (stack) holding device which presses a rear end portion of the aligned sheet S from above by a biasing force of biasing device 560. When the sheet S is aligned in the width direction and then aligned in the rear end as will be explained later and when the offset roller 407 is lifted thereafter by the pickups solenoid 433 as shown in FIG. 6A, thus aligned sheet S is pressed from above the sheet clamping member 412 as shown in FIG. 6B.

Such pressing of the sheet S from above allows to hold the sheet already discharged (conveyed) onto the treating tray 410 in a predetermined position, without being influenced or moved by the sheets S conveyed subsequently.

Figure 7A:
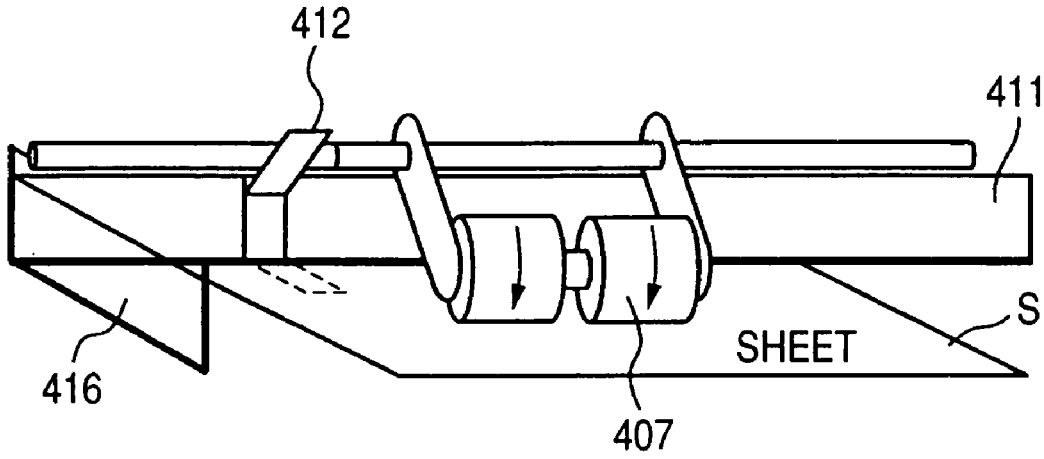
FIGS. 7A and 7B are second views showing a function of a sheet clamping member.
Figure 7B:
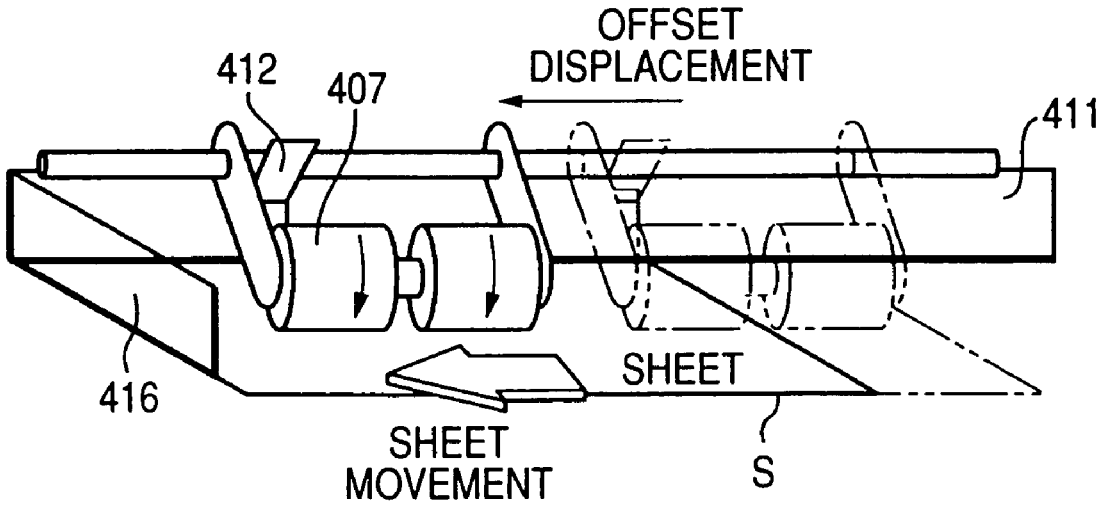

The sheet claming member 412 is rotated upwards as shown in FIG. 7A so as to accept the sheet S when the offset roller 407 is reverse rotated, and also rotated upwards when the sheet S is moved in the width direction together with the offset roller 407 for the end alignment, as shown in FIG. 7B so as not to constitute a load against the sheet movement.

Figure 8A:
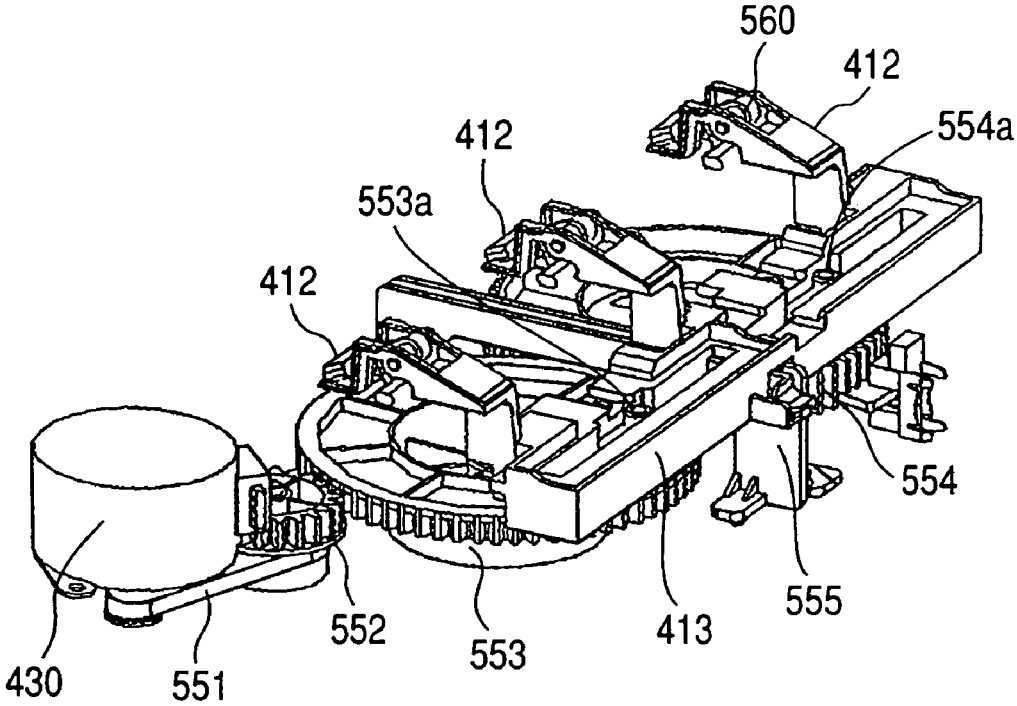
FIGS. 8A and 8B are views showing a drive mechanism for a sheet stack discharging member of the sheet treating apparatus.
Figure 8B:
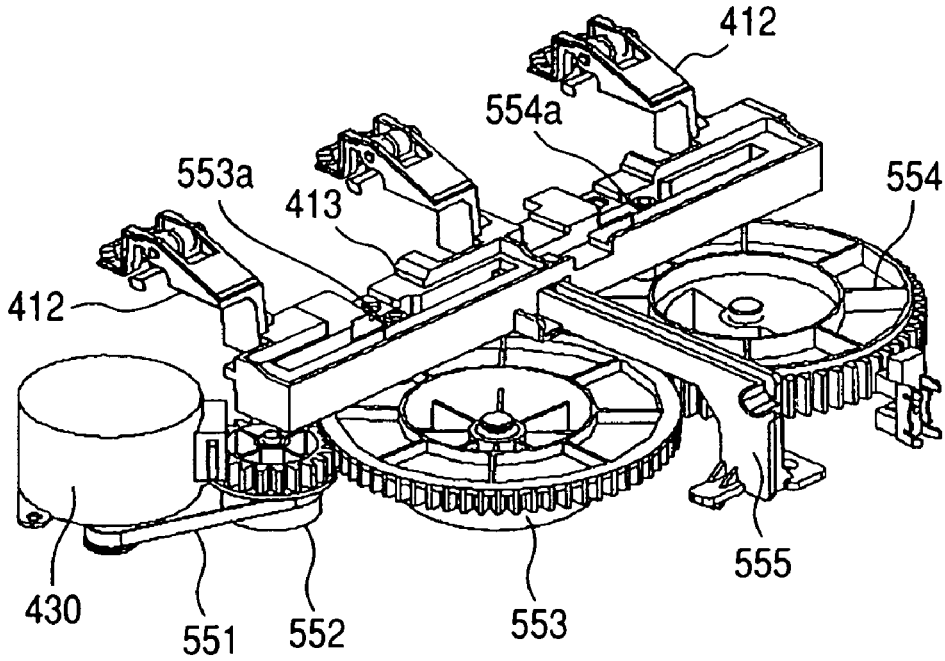
Figure 9:
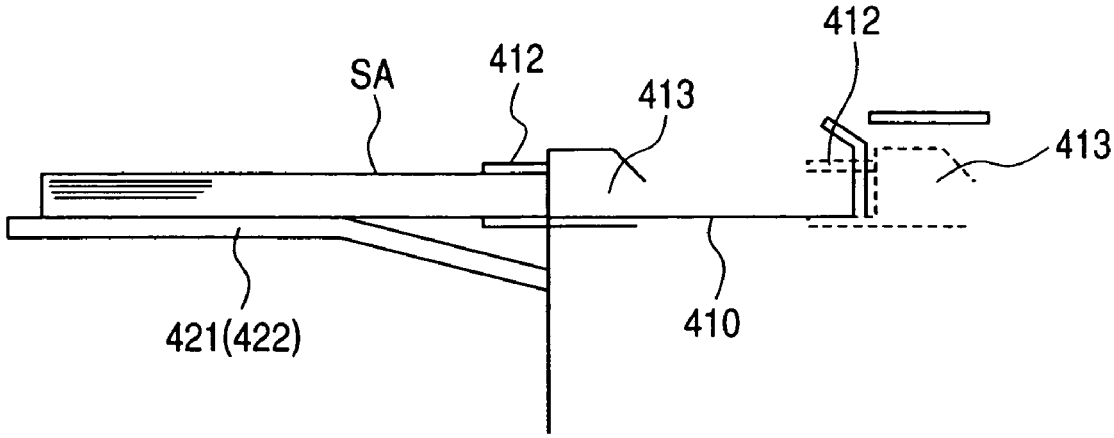
FIG. 9 is a view showing a state in which the sheet stack discharge member discharges a sheet stack onto a stacking tray.

In FIGS. 8A and 8B, a sheet stack discharge member 413 is illustrated as an example of discharge device which discharges a treated sheet stack onto a stacking tray (lower bin) 421 or a stacking tray (upper bin) 422, and such sheet stack discharge member 413 supports the sheet clamping member 412 in rotatable manner and moves an aligned sheet stack or an aligned and stapled sheet stack, in state held by the sheet clamping member 412, toward the stacking tray (lower bin) 421 or the stacking tray (upper bin) 422 provided at a downstream side of the treating tray 410 as shown in FIG. 9.

Thereafter, upon reaching a front end portion of the treating tray 410, constituting a sheet discharge position indicated by a solid line in FIG. 9, the sheet stack discharge member 413 stops in a state holding the sheet stack SA by the sheet clamping member 412 on the stacking tray 421 or 422, and then returns toward the sheet rear end stopper 411 while releasing the holding action of the sheet clamping member 412 on the sheet stack SA, thereby dropping the sheet stack SA. Such configuration allows to use the treating tray 410 and the stacking trays 421, 422 of a substantially horizontal angle (about 10° or less) as shown in FIGS. 2 and 9, instead of the prior angled stacking tray of an angle of about 30°. A stable stacking ability can be realized within a limited space, for example even with a small angle (for example about 9°) of the stacking tray as in the present embodiment.

Also the sheet stack SA discharged and stacked on the stacking tray 421, 422 is pressed by a pressing member 421A serving as sheet pressing device as shown in FIG. 2. Such pressing of the sheet stack SA by the pressing member 421A allows not only to prevent a decrease in the stacking property by a sheet curl but also to prevent a decrease in the stacking property for example a displacement in the stacking position of the already stacked sheet, by being pushed by a succeeding sheet. As a result, it is rendered possible to attain a stable stacking property with a small angle of the stacking tray as in the present embodiment, instead of a prior stacking tray angle of about 30° as explained above.

Now referring to FIGS. 8A and 8B, pins A 553*a* and B554*a*, provided on slide gears A 553 and B 554 rotated under a drive by a sheet stack discharge motor 430 through a belt 551 and a pulley gear 552, rotate integrally with the slide gears A 553 and B 554 and move in an unillustrated guide slit formed in the sheet stack discharge member 413, along with a displacement thereof.

In such structure, the sheet stack discharge member 413 executes a reciprocating motion along a slid rail 555 by the sheet stack discharge motor 430, between a sheet discharging position to the stacking tray (lower bin) 421 or the stacking tray (upper bin) 422 as shown in FIG. 8B and a home position in the vicinity of the sheet rear end stopper 411 as shown in FIG. 8A. The sheet stack discharge member 413 is normally fixed at the home position by an energization of the sheet stack discharge motor 430.

Figure 10:
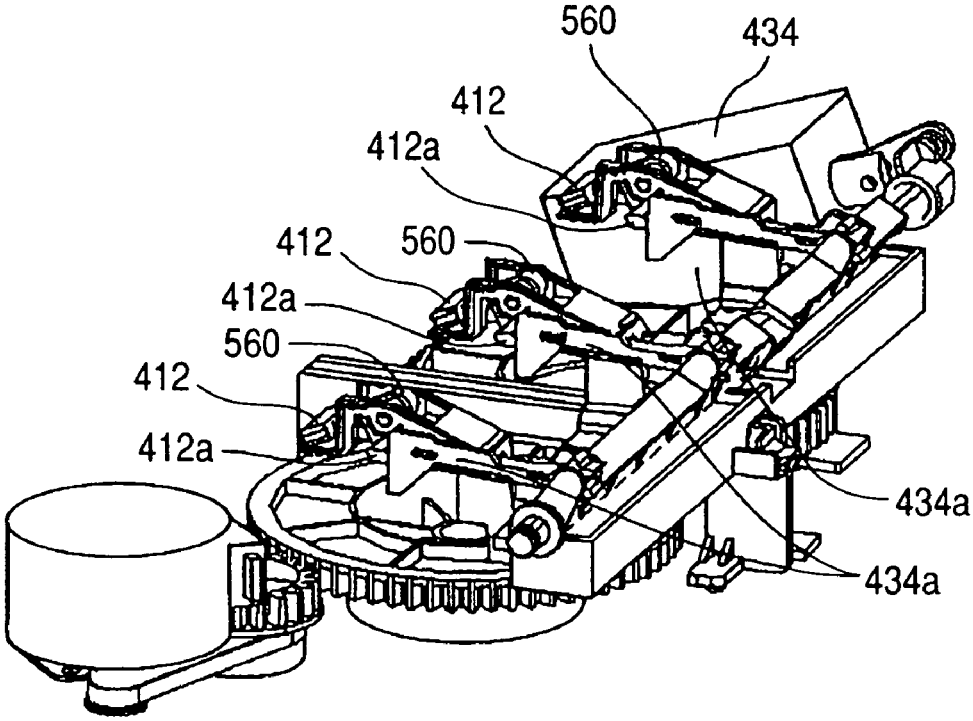
FIG. 10 is a view showing a function of the sheet clamping member of the sheet treating apparatus.

Referring to FIG. 10, a clamping solenoid 434 for rotating the sheet clamping member 412 is turned on when the offset roller 407 stops rotation after a sheet conveying or when the offset roller 407 is displaced in the width direction, thereby rotating upward the sheet clamping member 412 through a lever 434*a* and a releasing lever portion 412a provided on the sheet clamping member 412.

Figure 11A:
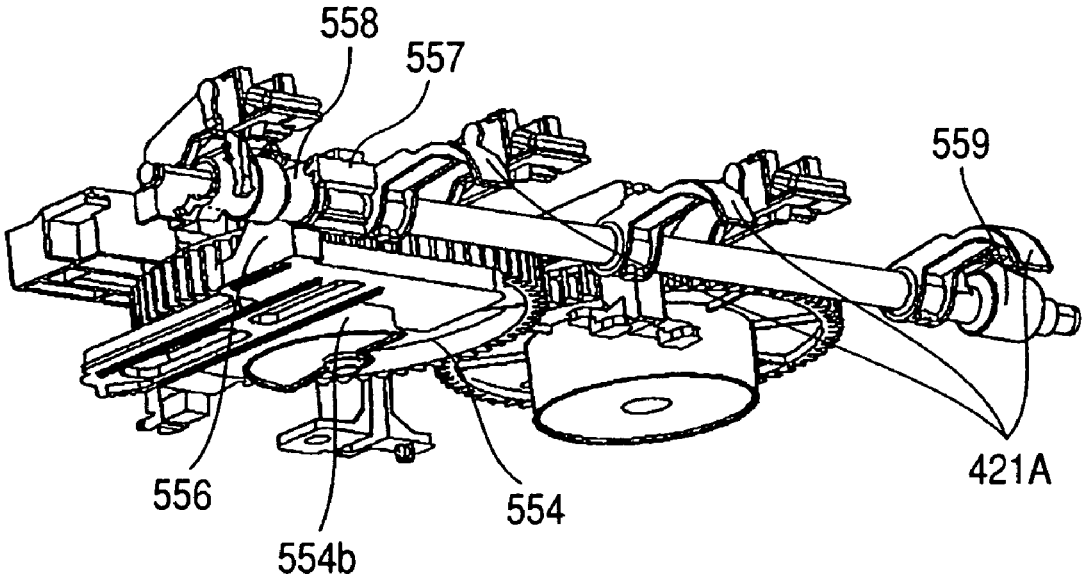
FIGS. 11A and 11B are views showing a drive mechanism for a pressing member of the sheet treating apparatus.
Figure 11B:
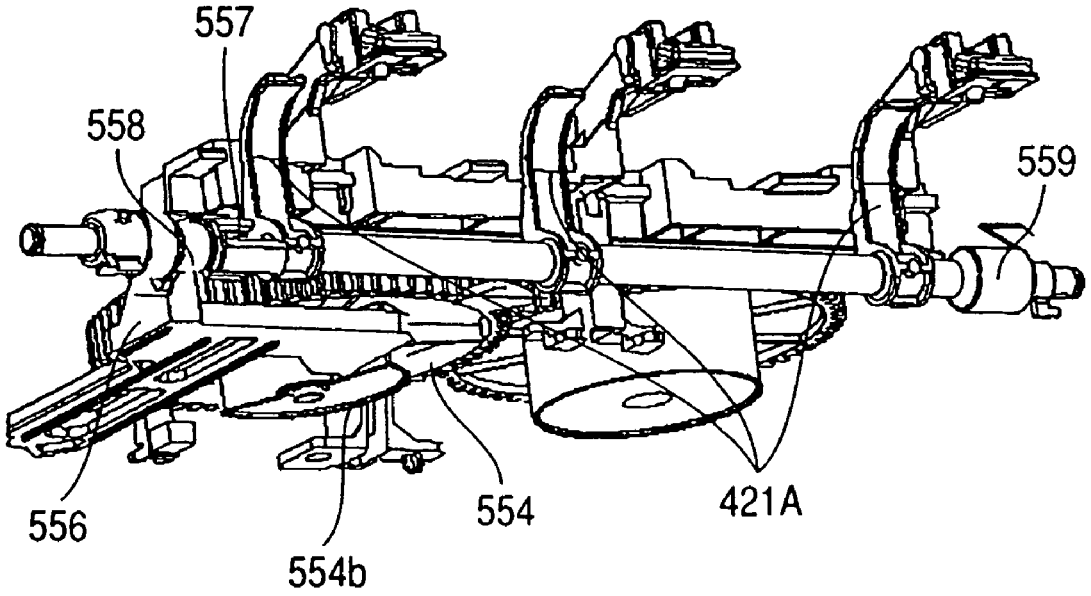

The pressing member 421A receives a power transmission as shown in FIG. 11A by a cam B 554*b*, provided under the slide gear B 554 and through a pressing member 556, a lever member 557 and a coil spring 558, thereby being rotated. Also the pressing member 421A, in a state without the power transmission, is positioned in a retracted state from the sheet stacking surface of the stacking trays 421, 422 by a return coil spring 559 as shown in FIG. 11B.

In such configuration, after the sheet stack discharge member 413 discharges the sheet stack onto the stacking tray 421, 422 by a rotation of the slide gear A 553 and the slide gear B 554 caused by a rotation of the stack discharge motor 430, when the cam B 554*b* releases a pressing function on the pressing member 556, the pressing member 421A assumes, by the return coil spring 559, a state where the sheet stack can drop to the stacking surface of the stacking tray 421, 422.

Thereafter, when the sheet stack drops to the stacking tray 421, 422 and the sheet stack discharging member 413 returns to the rear end stopper 411, the cam B 554*b* under the slide gear B 554 actuates the pressing member 556 thereby rotating the pressing member 421A through the lever member 567 and the coil spring 558 and causing the pressing member 421A to hold the sheet stack.

In the present embodiment, after the sheet S is displaced in the width direction as explained before, the offset roller 407 is again reversed in terminating the aligning operation in order to correct an aberration of the sheet in the conveying direction, whereby a highly precise alignment is realized. Then, when an alignment process is completed for the sheets of a designated number, the clamping solenoid 434 closes the sheet clamping member 412 thereby holding the sheet stack.

In the following, a driving operation for the stacking trays 421, 422 will be explained with reference to FIG. 12. At first, a tray motor 530 constituting an example of lifting and lowering device transmits a power, through a belt 531, a pulley 532 and a rotary shaft 533, to worm gears a 534 and b 535 provided on both ends of the rotary shaft. Then the power is transmitted from the worm gear a 534 to a worm wheel a 536, then from a gear 1*a* 537 integral with the worm wheel a 536 to a gear 2*a* 538, and from a gear 3*a* 539 integral with the gear 2*a* 538 to a rack a 540.

Also the power is transmitted from the worm gear b 535 to a worm wheel b 541, then from a gear 1*b* 542 integral with the worm wheel b 541 to a gear 2*b* 544, and from a gear 3*b* 543 integral with the gear 2*b* 544 to a rack b 545. The stacking trays 421, 422 can be lifted or lowered by such power transmission.

Figure 12:
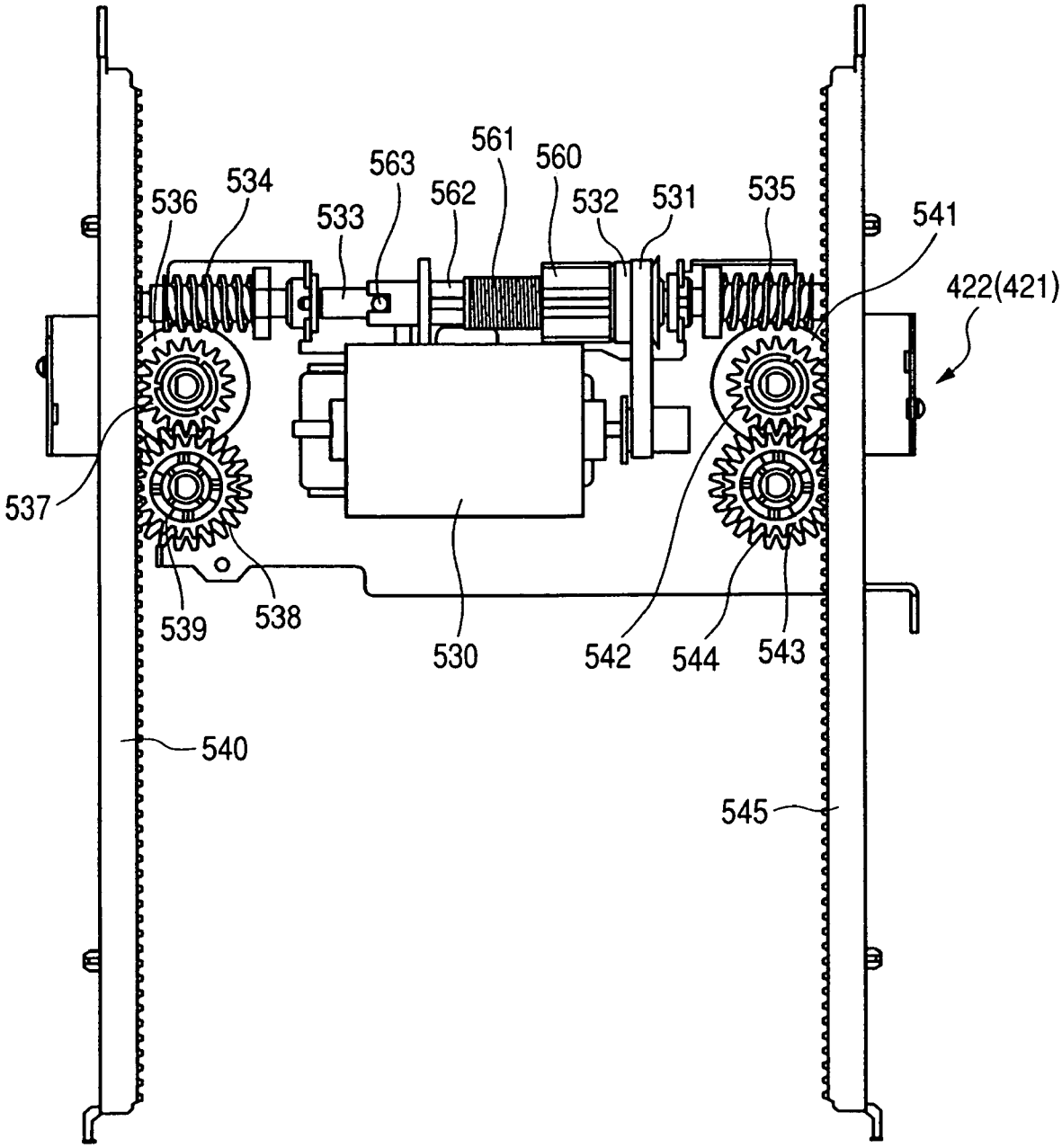
FIG. 12 is a view showing a drive mechanism for the stacking tray of the sheet treating apparatus.

Referring to FIG. 12, a spring 561 is wound on a clutch a 560 rotating in linkage with the pulley 532, and a clutch b 562 is provided on the other side of the spring 561. Also a pin 563 pressed in the rotary shaft 533 is fitted in a groove of the clutch b 562. Such configuration allows a transmission of a desire torque to the rotary shaft 533, through which the power is then transmitted to the worm gear a 534 and the worm gear b 535 provided on both ends of the rotary shaft.

When the stacking trays 421, 422 are vertically movably provided in a sheet stacking space SP1 to be explained later as in the present embodiment, and in case the stacking tray 421 or 422 does not stop at a predetermined position but continues to lift for some reason, not only the stacking tray 421, 422 or the sheets stacked thereon may abut on the upper stacking trays but also the uppermost stacking tray (upper bin) 422 or the sheets thereon may abut on a bottom surface (cf. FIG. 1) of the reader portion 120, constituting the upper face of the sheet stacking space SP1. For this reason, in the present embodiment, there is provided an upper limit sensor 547 as a sensor for restricting the movement of the stacking tray (upper bin) 422 as will be explained later.

However, in case an extraneous substance is present or a large amount of the sheets is stacked on the stacking tray (upper bin), such extraneous substance or the sheets may abut on the upper face of the sheet stacking space SP1 before the stacking tray (upper bin) 422 is detected by the upper limit sensor 547.

In case the stacking tray (upper bin) 422 continues lifting after such abutting of the extraneous substance or the sheets, there may result a breakage in the extraneous substance, sheets or the stacking trays (upper bin) 422, but in the present embodiment, the coil spring 561 is provided as limiting device between the tray motor 530 and the stacking trays (upper bin) 422 (421) as explained before thereby not transmitting the driving power of the tray motor 530 to the stacking trays (upper bin) 422 when a torque in lifting the stacking trays (upper bin) 422 exceeds a predetermined torque.

More specifically, when the extraneous substance or the sheets abuts on the upper face of the sheet stacking space SP1 and there is thereafter generated a load exceeding a torque set for the coil spring 561, the pulley 532 rotating together with the rotation of the tray motor 530 slips around the rotary shaft 533, whereby the rotary shaft 533 constituting a driving shaft for transmitting the driving power of the tray motor 530 to the stacking tray (upper bin) 422 is stopped, whereby the stacking tray (upper bin) 422 can no longer be lifted. Also in case the upper limit sensor 547 does not detect the stacking tray (upper bin) 422 even after a lapse of a predetermined time, a CPU 100 to be explained later terminates the driving of the tray motor 530 thereby terminating the lift of the stacking tray (upper bin) 422.

Thus, when the extraneous substance or the sheets abuts on the upper face of the sheet stacking space SP1, the coil spring 561 restricts the lift of the stacking tray (upper bin) 422, thereby avoiding breakage of the stacking tray (upper bin) 422 or the sheets or like stacked thereon.

Figure 23:
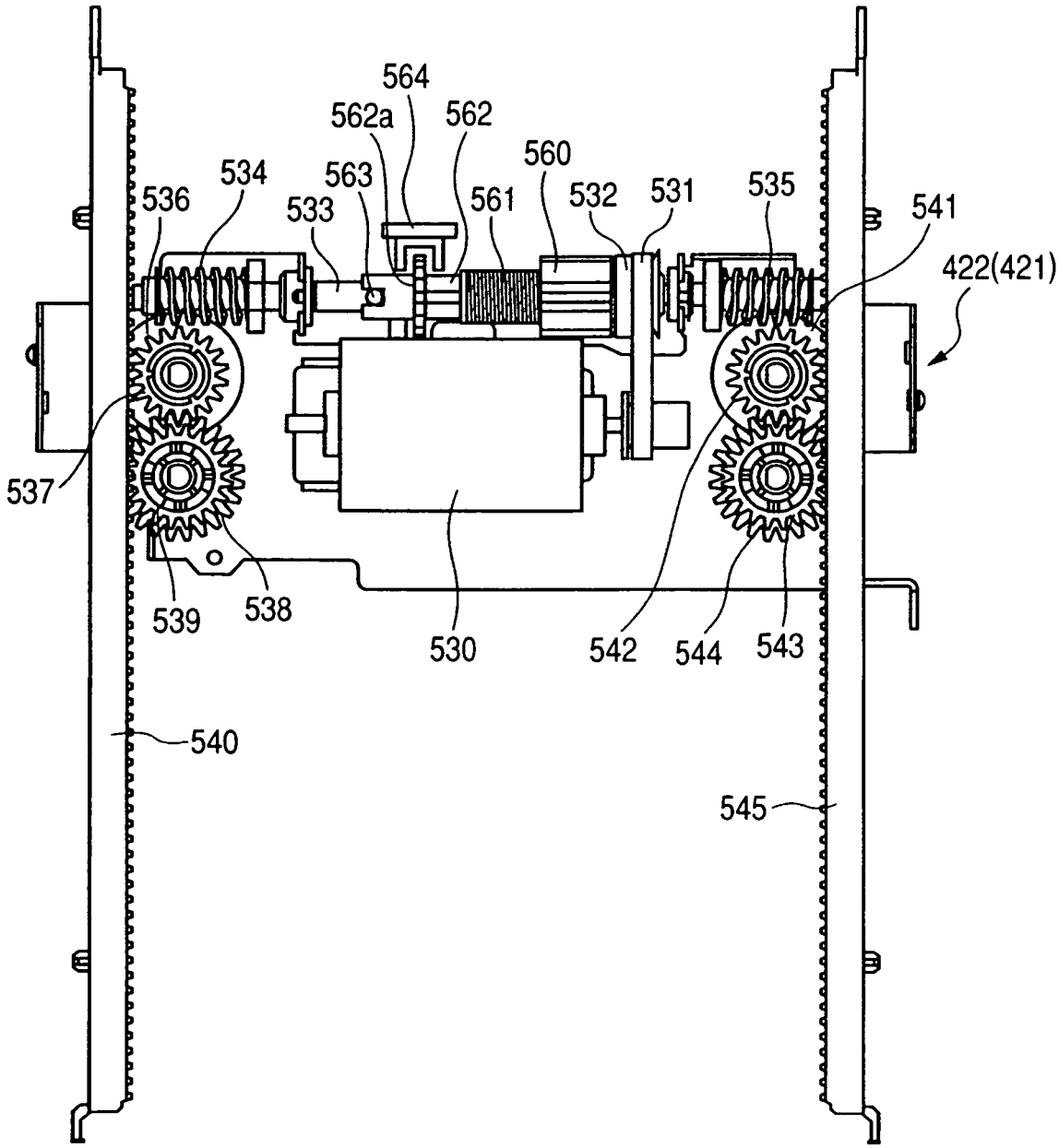
FIG. 23 is a view showing another mechanism for limiting lifting of the stacking tray of the sheet treating apparatus.

FIG. 23 shows another configuration for stopping the lift of the stacking tray (upper bin) 422 when the extraneous substance or the sheets abuts on the upper face of the sheet stacking space SP1, in which a disk portion 562*a* of the clutch b 562 is provided with slits of a constant pitch (encoder) and such encoder is detected by a rotation sensor 564 used as a sensor for detecting the rotation of the rotary shaft 533.

In such configuration, in case an extraneous substance becomes present before the stacking tray (upper bin) 422 completes lifting, the load increases and, when the rotary shaft 533 is stopped at a load exceeding a preset torque, an on/off operation of the rotation sensor 564 is terminated. Upon detecting such change, the CPU 100 terminates the driving of the tray motor 530 thereby stopping the lift of the stacking tray (upper bin) 422.

In the following, there will be explained a tray switching operation for the stacking tray (lower bin) 421 and the stacking tray (upper bin) 422.

The stacking tray (lower bin) 421 and the stacking tray (upper bin) 422 can be independently lifted or lowered by the tray motor 530 through a rack and a pinion, as already explained in FIG. 12. Such configuration having a driving source independently and enabling independent lifting and lowering allows the stacking tray (lower bin) 421 and the stacking tray (upper bin) 422 to selectively receive the treated sheets discharged by the sheet stack discharging member 413.

In a state shown in FIG. 1 or 2 in which a plurality (n; 2 in the present embodiment) of the stacking trays (sheet stacking devices) are positioned on both sides of the sheet discharge port 400A for discharging sheet by the sheet stack discharging member (discharge device), a large number of sheet can be stacked since a space is provided under the stacking tray (lower bin) 421, and it is also possible to stack a larger amount of sheets since the stacking is possible also on the upper bin, even when the stacking tray (upper bin) 422 is in a retracted state, by switching the upper and lower bins as will be explained later.

In the following there will be explained, in case the stacking tray (lower bin) 421 is in a position capable of receiving sheets and the stacking tray (upper bin) 422 is retracted to the upper side (FIG. 13A), an operation of moving the stacking tray (upper bin) 422 to a position capable of receiving sheets under the sheet discharge port 400A.

Below the stacking tray (lower bin) 421, there is provided a lower limit sensor 546 capable of detecting a lower limit, and, in the present operation, at first the stacking tray (lower bin) 421 is lowered to a position detected by the lower limit sensor 546.

Figure 14A:
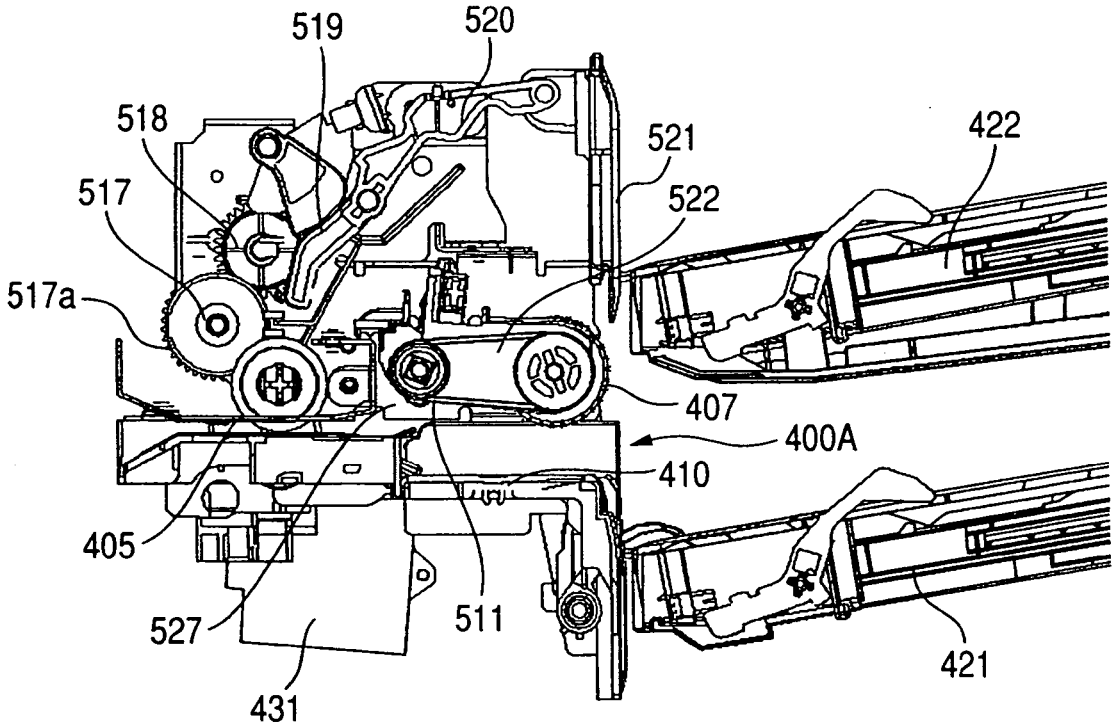
FIGS. 14A and 14B are views showing a drive mechanism for the shutter of the sheet treating apparatus.
Figure 14B:
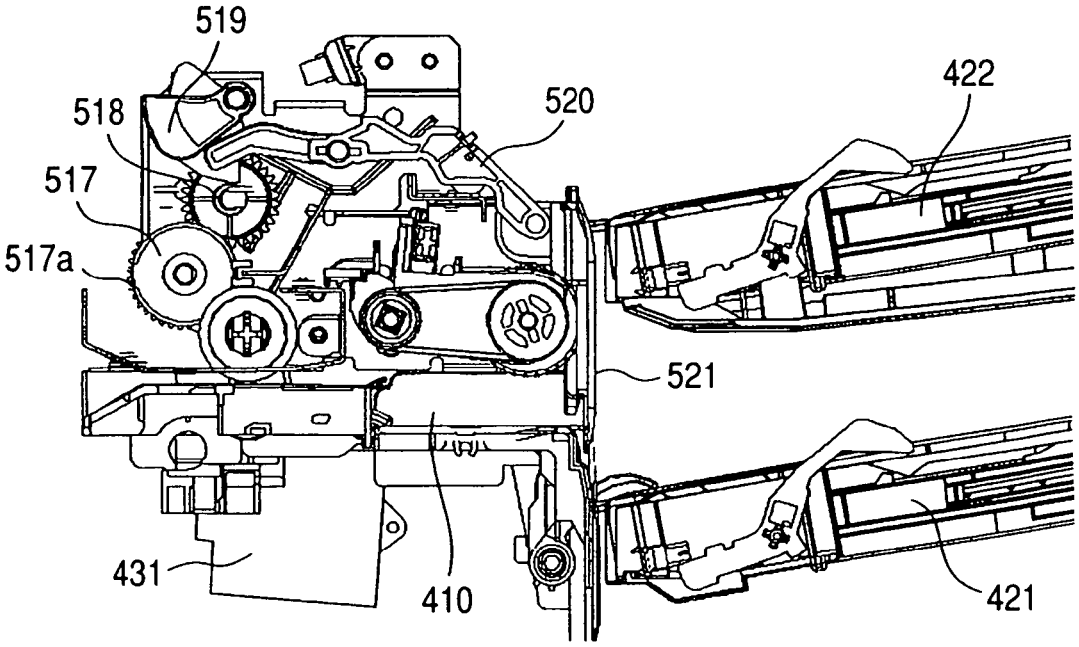

Then the pickup solenoid 433 shown in FIG. 4 is turned on to move the offset roller 407 to an upper waiting position as shown in FIG. 14A through the offset roller holder 406, then an electromagnetic clutch 517 is turned on in such state to connect the drive of the conveying motor 431, and the conveying motor 431 is then rotated by a predetermined amount to lower a shutter 521, as shown in FIG. 14B, through a gear portion 517*a* of the electromagnetic clutch 517, an idler gear 518, a cam gear 519 and a shutter lever 520.

Figure 15A:
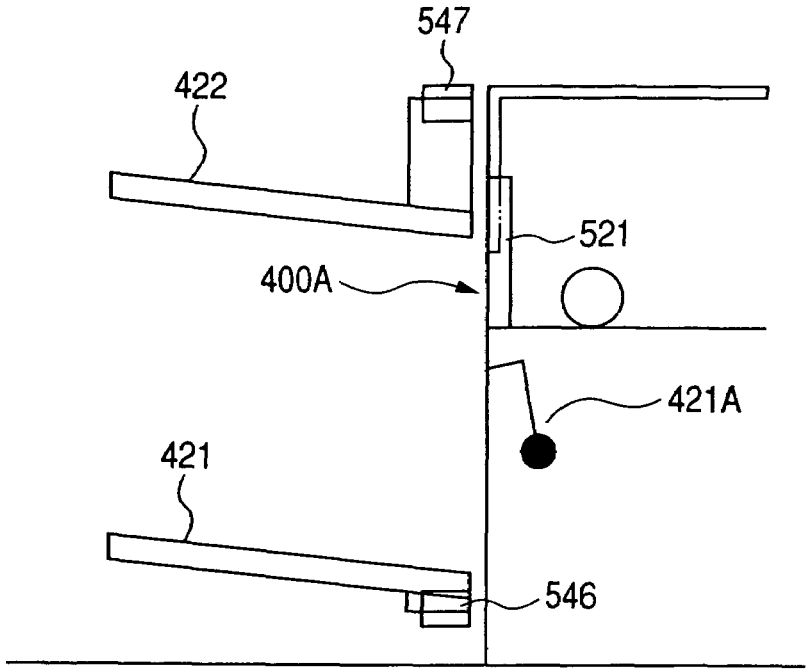
FIGS. 15A and 15B are second views showing functions of a stacking tray (lower bin), a stacking tray (upper bin) and a shutter of the sheet treating apparatus.

Such descent of the shutter 521 to close the sheet discharge port 400A of the treating tray 410 forms a guide surface for the sheet rear end (FIG. 15A) thereby preventing, at the shift of the stacking tray (upper bin) 422, a reverse entry of the sheets already stacked therein toward the treating tray.

Figure 15B:
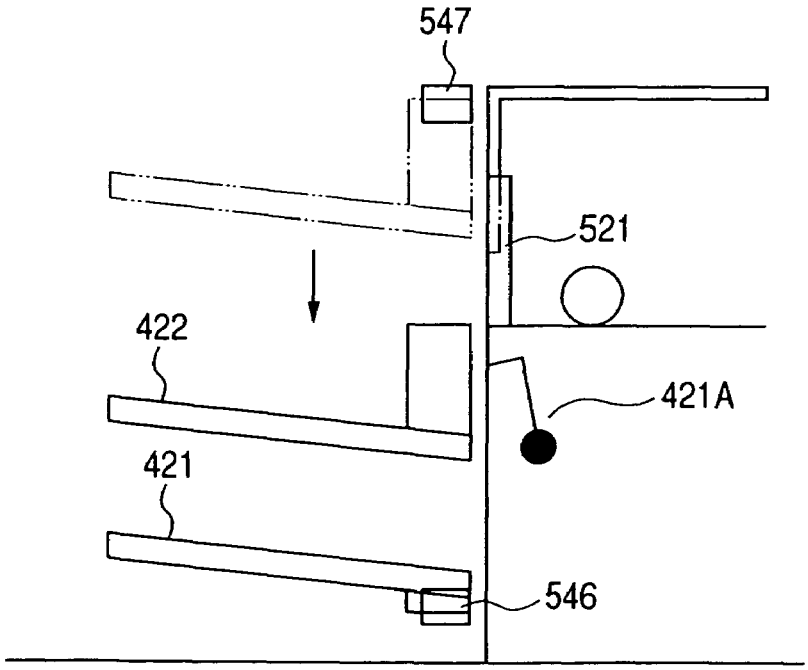
Figure 16A:
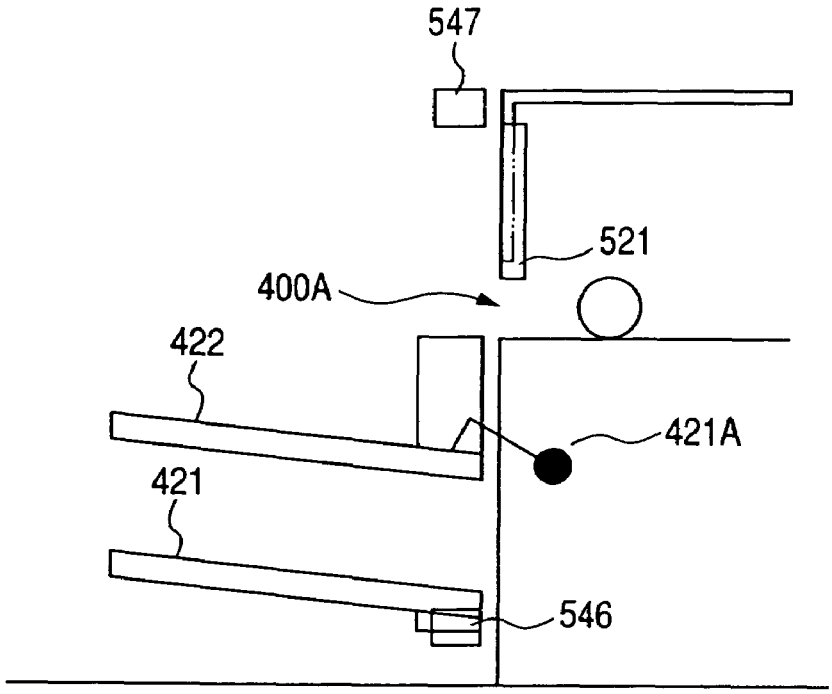
FIGS. 16A and 16B are third views showing functions of a stacking tray (lower bin), a stacking tray (upper bin) and a shutter of the sheet treating apparatus.

Then, when the descent of the shutter 521 is completed, the stacking tray (upper bin) 422 starts to descend and stops in a position after passing the pressing member 421A (FIG. 15B). Thereafter the shutter 521 is lifted and stopped at a desired position, then the retracted pressing member 421A is moved to a state capable of pressing the sheets, and the stacking tray (upper bin) 422 is lifted and stopped after a shift to a position for receiving the sheet (FIG. 16A). A displacement to such position allows a sheet reception as in the stacking tray (lower bin) 421.

In the following there will be explained, in case the stacking tray (upper bin) 422 is in a position capable of receiving sheets and the stacking tray (lower bin) 421 is retracted to the lower side (FIG. 16A), an operation of moving the stacking tray (lower bin) 421 to a position capable of receiving sheets.

Figure 16B:
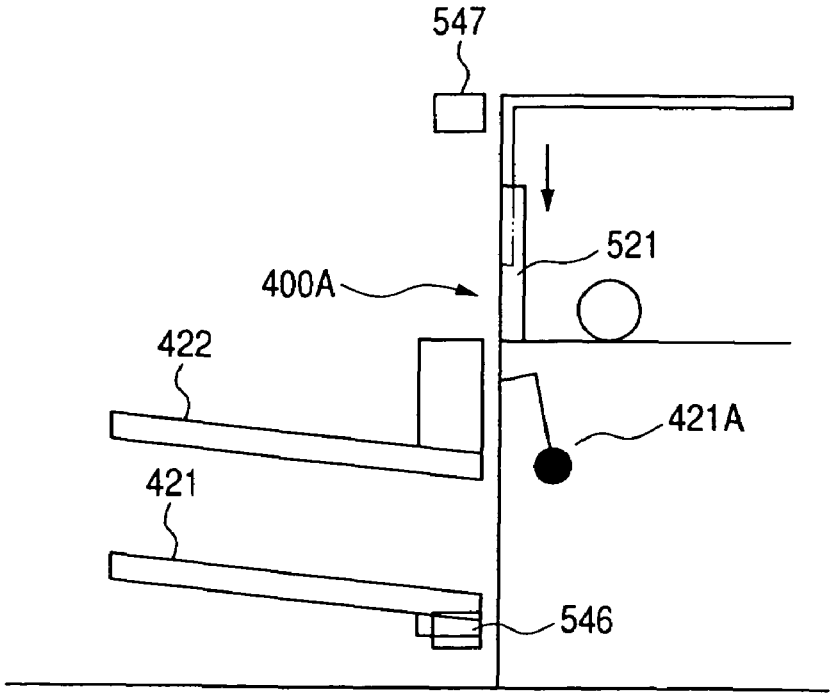

In this case, the pressing member 421A is at first returned to the retracted position, and the shutter 521 is lowered to prevent a reverse entry of the sheets already stacked in the stacking tray (upper bin) 422 toward the treating tray through the sheet discharge port 400A (FIG. 16B). Thereafter the stacking tray (upper bin) 422 starts to be lifted through the sheet discharge port 400A, to a space SPU provided above the sheet discharge port 400A.

Figure 17A:
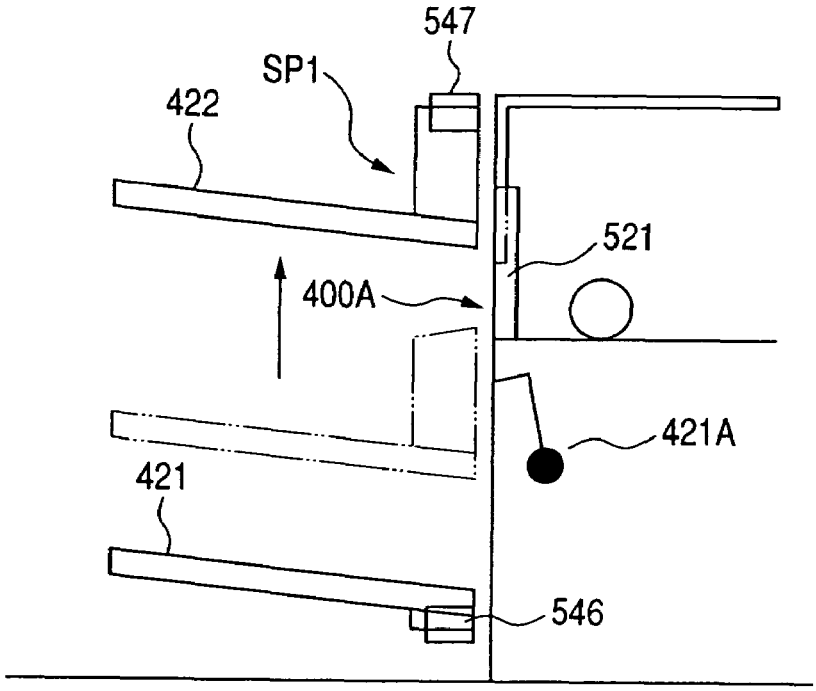
FIGS. 17A and 17B are fourth views showing functions of a stacking tray (lower bin), a stacking tray (upper bin) and a shutter of the sheet treating apparatus.

When the stacking tray (upper bin) 422, moving to the space SPU provided above the sheet discharge port 400A, is detected by the upper limit sensor 547 provided in the vicinity of the upper limit of the space SPU (in the present embodiment, in the vicinity of the bottom face (cf. FIG. 1) of the reader portion 120), the tray motor 530 is stopped thereby stopping the stacking tray (upper bin) 422 (FIG. 17A).

Figure 13A:
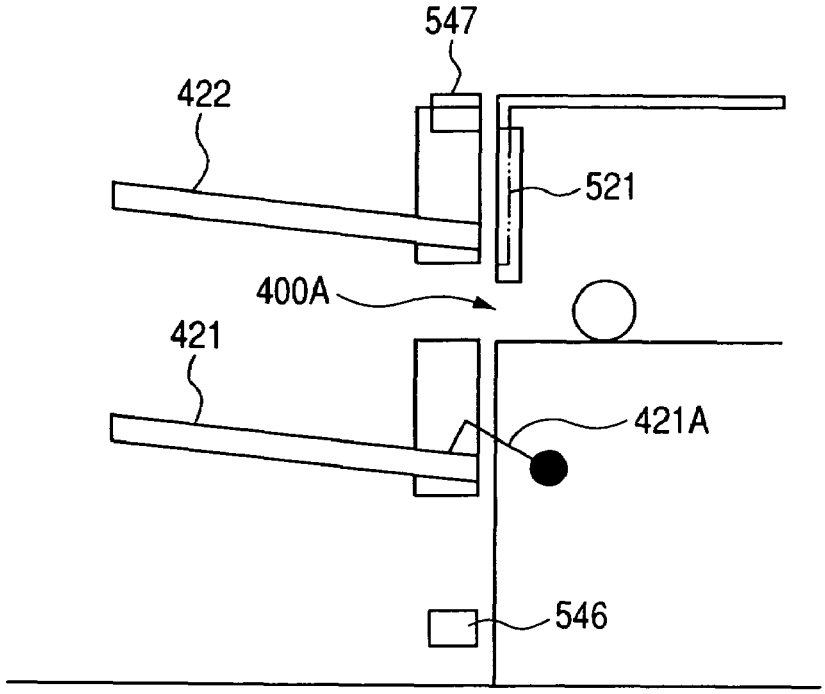
FIGS. 13A and 13B are first views showing functions of a stacking tray (lower bin), a stacking tray (upper bin) and a shutter of the sheet treating apparatus.
Figure 13B:
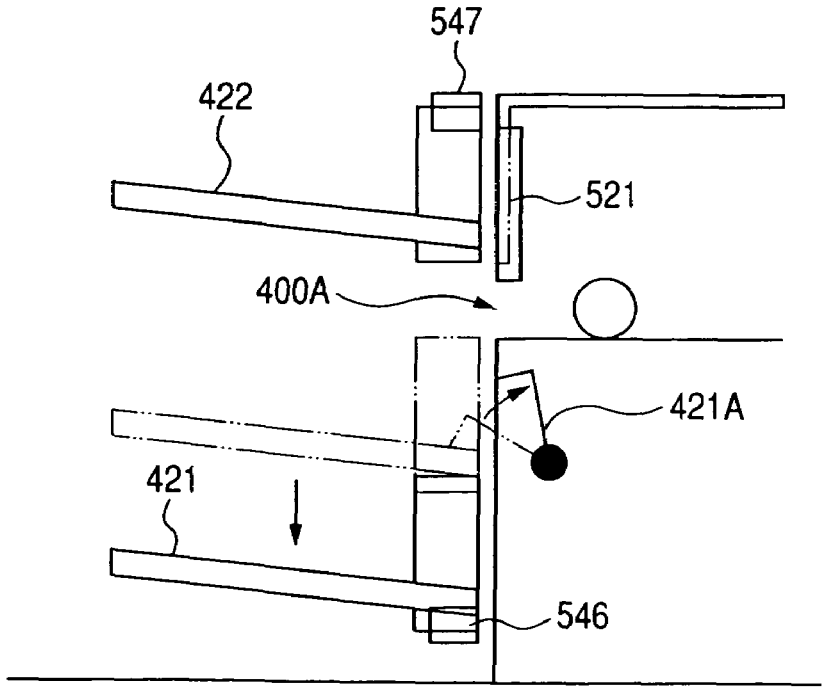
Figure 17B:
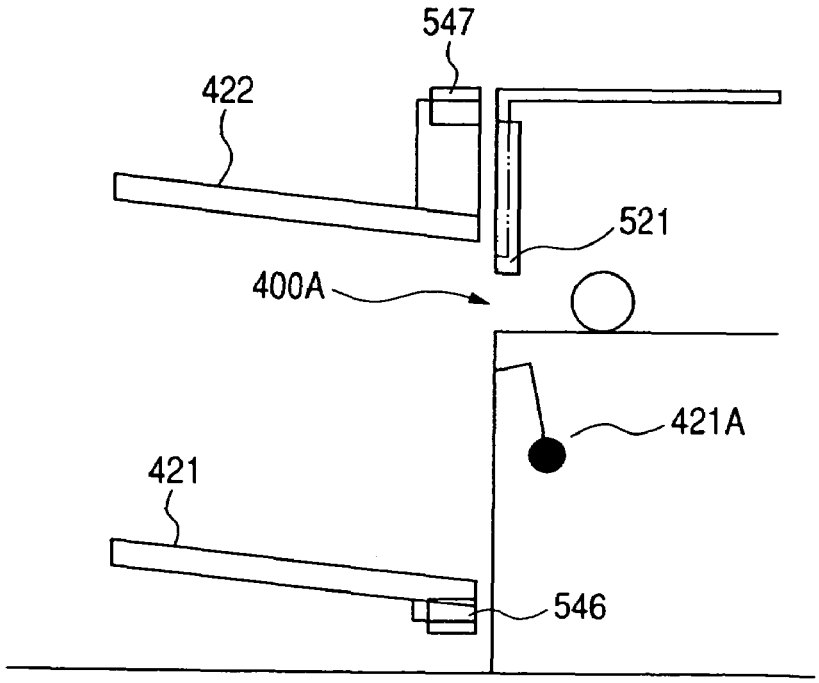

Then, the shutter 521 is lifted to a desired position and is stopped after opening the sheet discharge port 400A (FIG. 17B). Then the retracted pressing member 421A is moved to a state capable of pressing the sheets, and the stacking tray (lower bin) 421 is lifted and stopped after a shift to a position for receiving the sheet (FIG. 13A). A displacement to such position allows a sheet reception by the stacking tray (lower bin) 421.

Thus, by providing the sheet treating apparatus 400 accommodated in the space SP (cf. FIG. 1) formed in the lateral part of the main body 500A of the image forming apparatus with plural sheet stacking trays 421, 422 capable of lifting and lowering independently, and by selectively stacking sheets on these plural stacking trays 421, 422, it is rendered possible to achieve a space saving and to easily distinguish the sheet was outputted in correspondence with which mode even when the sheet treating apparatus 400 is accommodated in a composite printer having various modes such as a copying machine, a printer, a facsimile and the like. It is also rendered possible to achieve a classified stacking according to the modes such as copying, printing, facsimile and the like, and to provide an apparatus optimum for the needs of the offices.

Also by moving the stacking tray (upper bin) 422 higher than the sheet discharge port 400A, it is rendered possible to utilize, within the space SP formed in the lateral part of the main body 500A of the image forming apparatus, a space SPU above the sheet discharge port 400A within the sheet stacking space SP1 for vertically moving the stacking trays 421, 422 as a sheet stacking space, whereby a large amount of sheet can be stacked.

In case of utilizing the space SPU above the sheet discharge port 400A as a space for sheet stacking, the sheet discharge port 400A is preferably provided at an approximate center in the height direction of the sheet stacking space SP1. The sheet discharge port 400A provided in such position allows to stack a large amount of sheet by efficiently utilizing the sheet stacking space SP1.

In the foregoing, there has been explained a case of having two stacking trays as the sheet stacking devices, but by providing a plurality (n) of stacking trays and by rendering (n-1) stacking trays, within plural (n) sheet stacking devices, movable in the space SPU above-the sheet discharge port 400A, it is possible to stack a large amount of sheet by efficiently utilizing the sheet stacking space SP1.

Also, as in the present embodiment, by employing the sheet discharge port 400A as a common sheet discharge port in the modes such as copying machine, printer, facsimile and the like and by selectively discharging the sheet from the common sheet discharge port 400A to the plural stacking trays, it is possible to achieve a space saving and to suppress the dimension in height. Also by employing the sheet discharge port 400A as a common sheet discharge port and by discharging the sheets from the sheet discharge port 400A to the respectively stacking trays by a single sheet stack discharge member 413, it is rendered possible to simplify the structure thereby achieving a cost reduction.

Figure 18A:
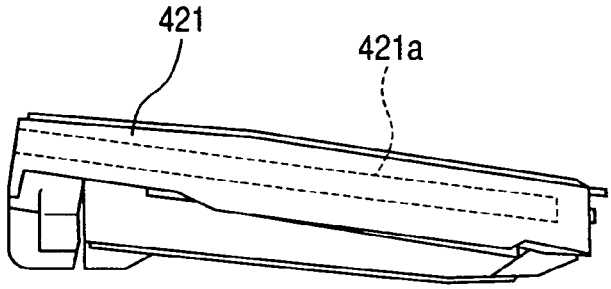
FIGS. 18A and 18B are views showing a configuration of the stacking tray (lower bin), the stacking tray (upper bin) and the shutter of the sheet treating apparatus.

At the downstream end of the stacking trays 421, 422 in the sheet discharging direction, there is stored, as shown in FIG. 18A, a sub tray 421*a* as preliminary sheet stacking device in an extractable manner. The stacking trays 421, 422 are positioned without protruding from the main body 500A of the image forming apparatus, and are capable of stacking sheets of frequently used sizes such as A4, B5 or letter size (or sheets of smaller sizes).

Figure 18B:
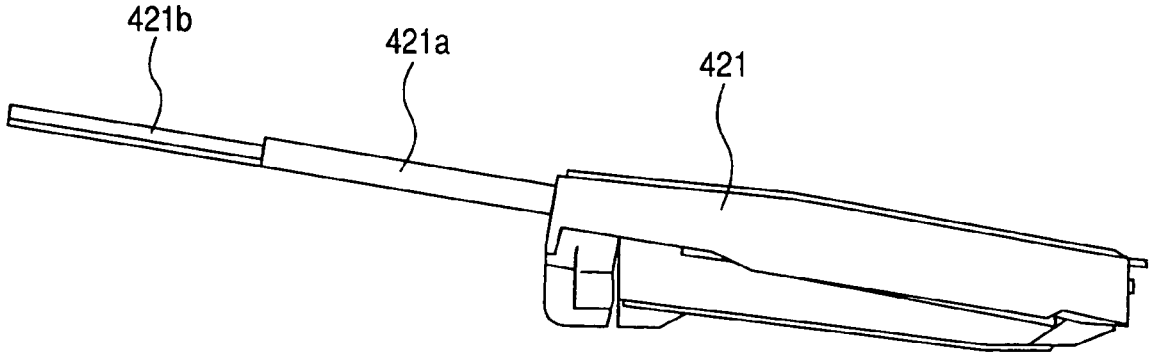

On the other hand, in case of stacking sheets of a larger size such as A3, B4 or legal size, the sub tray 421*a* stored inside the stacking tray 421 or 422 is extracted when necessary. In the present embodiment, the sub tray 421*a* is further provided with another slidable sub tray 421*b*, and the two sub trays 421*a*, 421*b* are extracted according to the sheet size as shown in FIG. 18B to enable satisfactory sheet stacking. Also the other stacking tray 422 (upper bin) has a similar structure.

Figure 19:
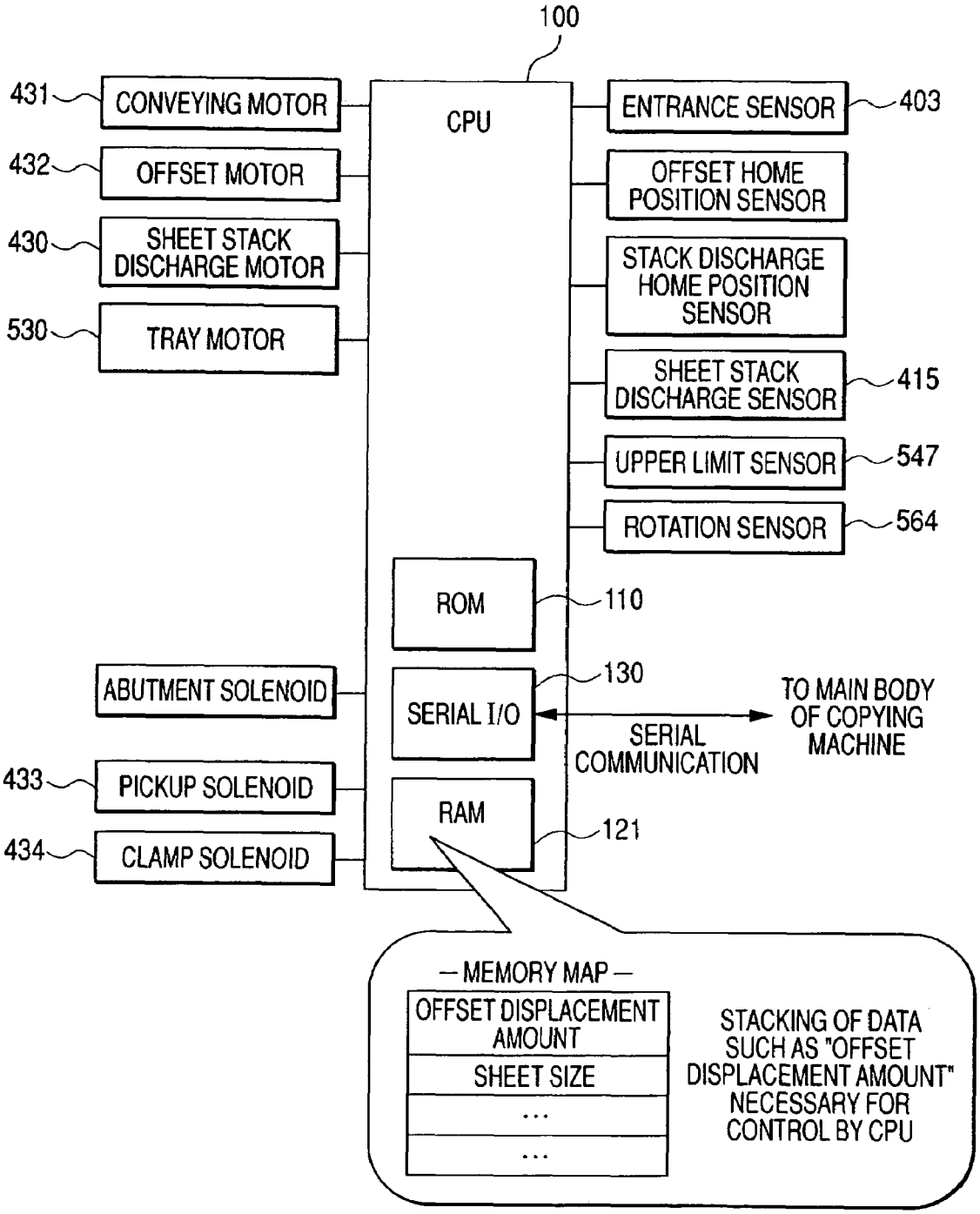
FIG. 19 is a block diagram showing a configuration of a control portion of the sheet treating apparatus.

FIG. 19 is a block diagram showing a configuration of a control portion of the sheet treating apparatus 400, wherein a CPU 100 is provided as control device in the present embodiment. The CPU 100 is provided therein with a ROM 110 for storing programs corresponding to the control procedures shown in FIGS. 30 and 21. The CPU 100 controls various parts by reading such programs.

The CPU 100 is further provided therein with a RAM 112 storing work data and input data, and the CPU 100 executes control by referring to the data stored in the RAM 121 based on the aforementioned programs. Furthermore, the CPU 100 is connected, at input ports thereof, to sensors such as the entrance sensor 403 and the sheet stack discharge sensor 415, and at output ports thereof, to motors and solenoids such as the conveying motor 431, the offset motor 432, the sheet stack discharge motor 430, the pickup solenoid 433, and the clamping solenoid 434. Based on the states of such sensors, the CPU 100 controls loads such as motors and solenoids connected to the output ports according to the aforementioned programs.

The CPU 100 is further provided with a serial interface (I/O) 130, and exchanges control data with the main body 500A (control portion thereof) of the image forming apparatus, and further controls various parts based on control data transmitted from the main body 500A (control portion thereof) of the image forming apparatus through the serial interface (I/O) 130.

As the main body 500A of the image forming apparatus understands the sizes of the sheets discharged from the sheet discharge portion 208, the control portion of the sheet treating apparatus 400, constituted by a microcomputer system, can recognize the sizes of the sheets inserted into the treating tray 410 by a serial communication with the control portion of the main body 500A of the image forming apparatus.

Consequently, for each discharge (conveying) of a sheet S from the main body 500A of the image forming apparatus, the control portion (CPU 100) of the sheet treating apparatus 400 recognizes the size thereof and controls the offset motor 432 thereby controlling a movement amount of the offset roller 407 in the width direction. Thus the offset roller 407 moves by an amount corresponding to the size of the sheet S inserted into the treating tray 410, thereby causing the lateral portion of the sheet to securely abut on the position wall 416.

In the present embodiment, as the sheet stack on the stacking tray 421 constitutes a part of the treating tray 410, when a sheet stack SA is discharged from the treating tray 410, the stacking tray 421 is lowered by a stacking tray lifting and lowering motor (tray motor) (cf. FIG. 12) until the uppermost surface of the stacked sheets substantially matches the treating tray 410.

In the following, a sheet treating operation of the sheet treating apparatus 400 of the present embodiment, constructed as explained above, will be explained with reference to flow charts shown in FIGS. 20 and 21.

At first, when an image forming operation is initiated by the main body 500A of the image forming apparatus, the CPU 100 (cf. FIG. 19) of the sheet treating apparatus 400 discriminates whether a sheet discharge signal is received from the main body 500A of the image forming apparatus (S100). In case a sheet discharge signal is received (Y in S100), the pickup solenoid 433 is turned on (S100) to pull up the offset roller 407 supported by the offset roller holder 406.

Then the conveying motor 431 is turned on (S120) to enable the conveying roller 405, provided on the sheet discharge path, to convey the sheet in a direction same as the sheet discharge direction of the main body 500A of the image forming apparatus. Then a front end of a first sheet passes and turn on the entrance sensor 403 (Y in S130), then the sheet reaches the conveying roller 405 thereby receiving a driving power therefrom, and the sheet transfer is completed when the sheet leaves the sheet discharge portion 208 (cf. FIG. 1) of the main body 500A of the image forming apparatus.

Then the sheet is conveyed by the conveying roller 405 to the treating tray 410, and the pickup solenoid 433 is turned off before the sheet leaves the conveying roller 405 (S150), thereby causing the offset roller 407 to land by the weight thereof onto the sheet. Thereafter, as shown in FIG. 5A, the sheet S is conveyed to a predetermined position by the offset roller 407 (S160). When the sheet is conveyed to the predetermined position (Y in S160), the rotation of the conveying motor 431 is stopped (S170) to terminate the conveying of the sheet S.

Then, when the rotation of the offset roller 407 is terminated, the clamping solenoid 434 is turned on (S180), thereby opening the sheet clamping member 412 provided in the home position in the vicinity of the sheet rear end stopper 411 as shown in FIG. 5B. Thereafter the conveying motor 431 is reversed in a direction opposite to the conveying direction to pull back the sheet S by the offset roller 407 (S190) thereby causing the rear end of the sheet to abut on the sheet rear end stopper 411.

An amount of rotation of the offset roller 407 in causing the rear end of the sheet to abut on the sheet rear end stopper 411 is so selected, in consideration of a skewed feed of the sheet S possibly caused in the conveying from the main body 500A of the image forming apparatus, as to execute a conveying somewhat larger than a distance from a position where the sheet S is stopped and switched back to the sheet rear end stopper 411. Thus the offset roller 407 is made to rotate for a predetermined time even after a conveying to cause the sheet S to abut on the sheet rear end stopper 411.

In this manner the sheet S can be made to securely abut on the sheet rear end stopper 411. When the sheet abuts on the rear end stopper 411 during the reverse rotation for such predetermined time, the offset roller 407 rotates idly (slips) on the sheet.

Then a size of the discharged sheet is checked by size information from the main body 500A of the image forming apparatus (S200), and there is calculated an offset displacement amount according to the size of the discharged sheet S, which is a displacement amount of the sheet S in the width direction, necessary for pressing the sheet S discharged on the treating tray 410 to the positioning wall 416 (S210).

Then the offset motor 432 is driven to start an offset movement of the offset roller 407 (S220). When the offset roller 407 is thus moved, the sheet S in contact with the offset roller 407 is moved by the frictional force of the offset roller 407, together with the offset roller 407, toward the positioning wall 416. In this state, the sheet clamping member 412 is rotated upwards as shown in FIG. 7B, in order not to form a load to the movement of the sheet S.

By such offset movement of the offset roller 407, the sheet abuts on the positioning wall 416 as shown in FIG. 5C, whereby the sheet S is aligned in the width direction. The offset roller 407, after causing the sheet S to abut on the positioning wall 416, slides on the sheet S for a while and is then stopped. Thereafter, in order to correct an aberration in the alignment in the conveying direction after the offset movement, the offset roller 407 is reversed again to execute an alignment operation of pulling back the sheet S (S230), whereby the alignment of the first sheet S is completed.

Then, when the alignment of the first sheet S is completed in this manner, the pickup solenoid 433 is turned on (S240) to lift up the offset roller 407 as shown in FIG. 6A, the clamping solenoid is turned off (S250). Thus the sheet clamping member 412 is closed as shown in FIG. 6B to pinch and hold the already aligned sheet, whereby the first discharged sheet is prevented from being carried by a next discharge sheet.

Then, as shown in FIG. 6B, the offset roller 407 in the lifted state is returned to the home position by the offset motor 432, through a rack and a pinion.

Then there is checked whether the sheet S accommodated on the treating tray 410 is a final sheet corresponding a last page of the original for copying (S270), and, in case it is judged as not the last sheet based on the information transmitted from the main body 500A of the image forming apparatus (N in S270), the sequence returns to the step S100 to receive a sheet discharge signal transmitted from the main body 500A of the image forming apparatus, and the above-described flow is repeated until the last sheet S is accommodated in the treating tray 140.

In such configuration, each time a sheet S is discharged from the main body 500A of the image forming apparatus, the control portion (CPU) of the sheet treating apparatus 400 recognizes the sheet S and calculates an amount of offset movement suitable for such sheet S. As a result, the sheet S in contact with the offset roller 407 is subjected to an alignment based on the calculated amount of movement, and is aligned to the positioning wall 416.

On the other hand, in case the sheet is judged as the last sheet (Y in S270), a sheet stack is formed in correspondence with the originals for copying on the treating tray 410. Then there is checked whether a stapling treatment is selected (S280), and, if selected (Y in S280), a stapler unit 420 is activated to execute a stapling treatment in a stapling position shown in FIG. 22.

In case a stapling treatment is not selected (N in S280) or after a stapling treatment is completed, the sheet stack discharge member 413 is advanced by the sheet stack discharge motor 430, in a state where the sheet stack SA is clamped by the sheet clamping member 412, toward the stacking tray 421, thereby discharging the sheet stack SA (S300).

Then, in synchronization with the discharge operation of the sheet stack SA, a movement (descent) of the stacking tray 421 is executed (S310), and the sheet stack discharge member 413 is thereafter returned to the home position (S320). Thereafter, the conveying motor 431 is stopped to terminate the rotation of the conveying roller 405 and the offset roller 407 (S330), and the pickup solenoid 433 is turned off (S340) to lower the offset roller 407 whereby a serial procedure is completed.

As already explained in the foregoing, by so selecting an amount of rotation of the offset roller 407 in causing the rear end of the sheet to abut on the sheet rear end stopper 411 as to execute a conveying somewhat larger than a distance from a position where the sheet S is stopped and switched back to the sheet rear end stopper 411, namely by rotating the offset roller 407 in the reverse direction even after rotating the offset roller 407 in the reverse direction for conveying the sheet S by a distance for causing the rear end of the sheet to abut on the sheet rear end stopper 411, the sheet S can be made to securely abut on the sheet rear end stopper 411.

In this manner a stable alignment of the sheet S in the sheet conveying direction can be achieved with a simple configuration not requiring many components. Also as the sheet is not discharged in a flying manner, the sheet can be conveyed stably with little positional aberration.

In the foregoing description, in case of stapling a sheet stack, the offset roller 407 is made to function as sorting device and the stapling treatment is executed after the sheet stack is made to abut on the positioning wall 416, but, in case the stapling treatment is not executed, the sheets may be discharged without sorting by the offset roller 407.

Also in the present embodiment, the stapler unit 420 constituting binding device which binds the sheet stack SA is constructed as a fixing type provided in the vicinity of the positioning wall 416, but the present invention is not limited to such type, and the stapler unit 420 may be constructed as a movable type and rendered movable in the sheet conveying direction or in the width direction.

By employing the stapler unit 420 of such movable type and moving such stapler unit 420 in the sheet conveying direction or in the width direction, it is possible to execute the stapling treatment in another position or in plural positions of the sheet stack SA in the sheet conveying direction or in the width direction.

Also the present embodiment employs the offset roller 407 as the sheet conveying device as device which moves the sheet S in the width direction and the offset motor 432 as drive device, but the present invention is not limited to such configuration, and a similar effect can be obtained by constructing displacement device by sheet conveying device of a structure which conveys a sheet by a movement of a member itself in the conveying direction, and drive device which moves such sheet conveying device in the width direction.

Figure 20:
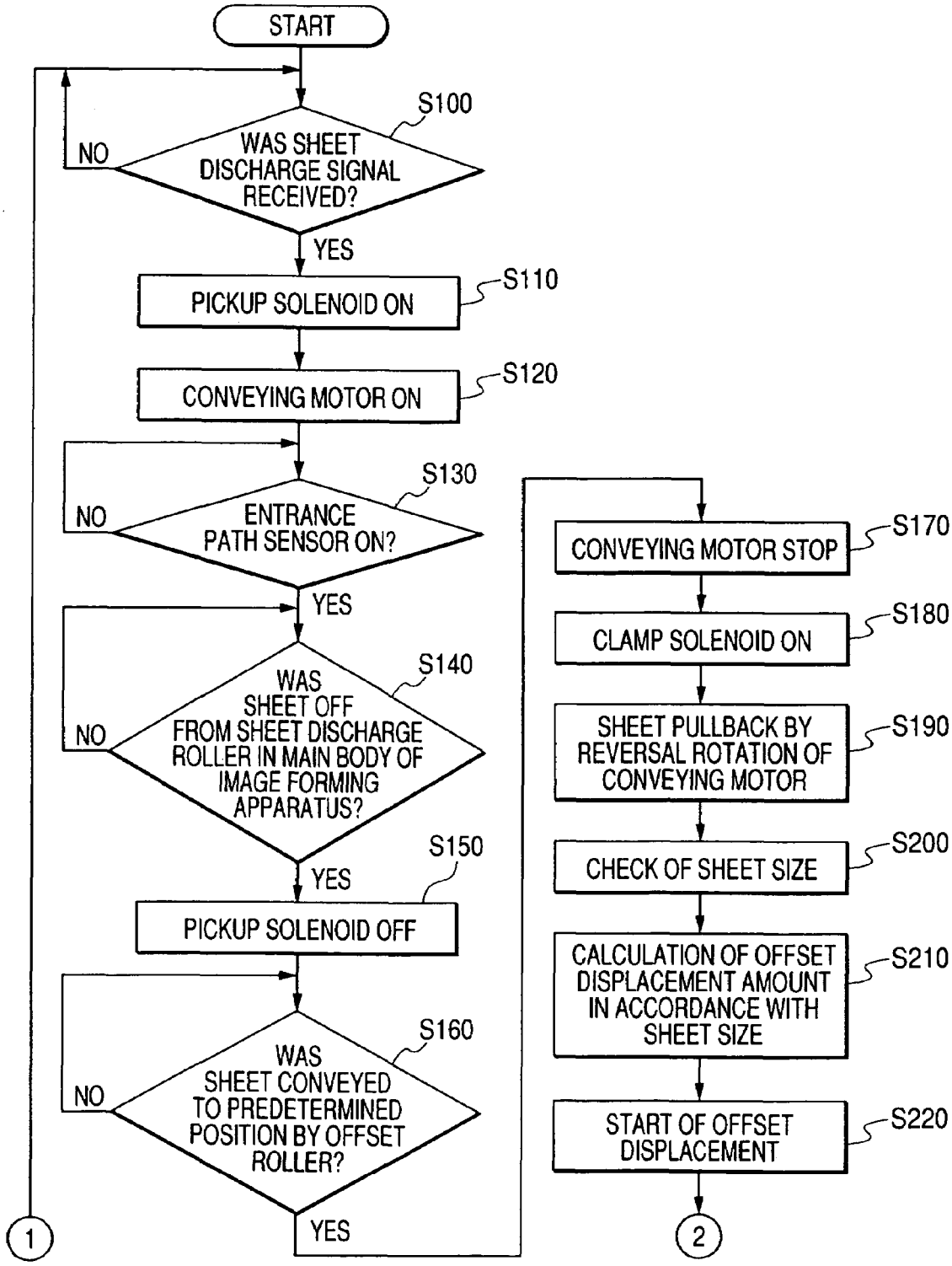
FIG. 20 is a flow chart showing a part of sheet treating operation of the sheet treating apparatus.
Figure 21:
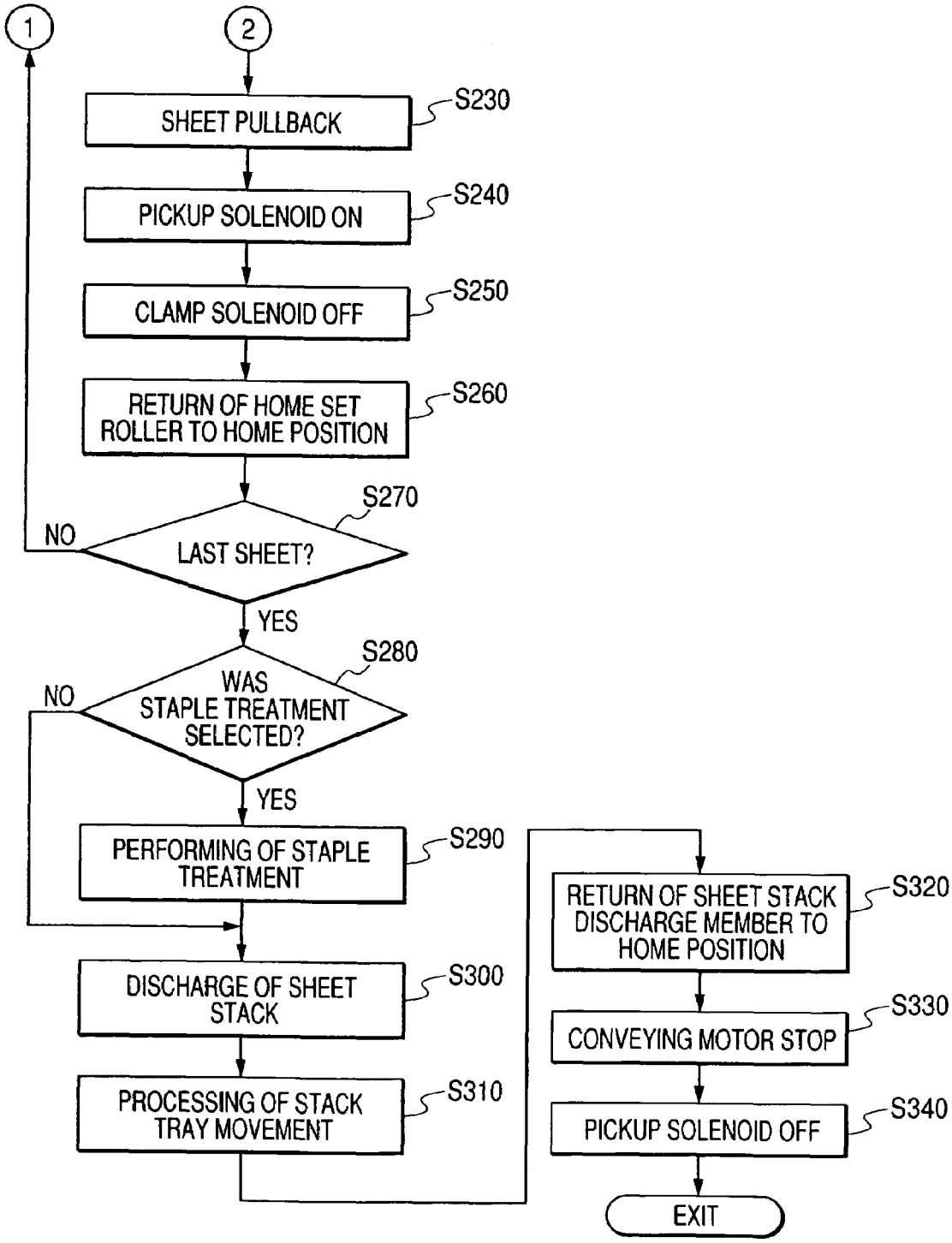
FIG. 21 is a flow chart showing a remaining part of the sheet treating operation of the sheet treating apparatus.
Figure 22:
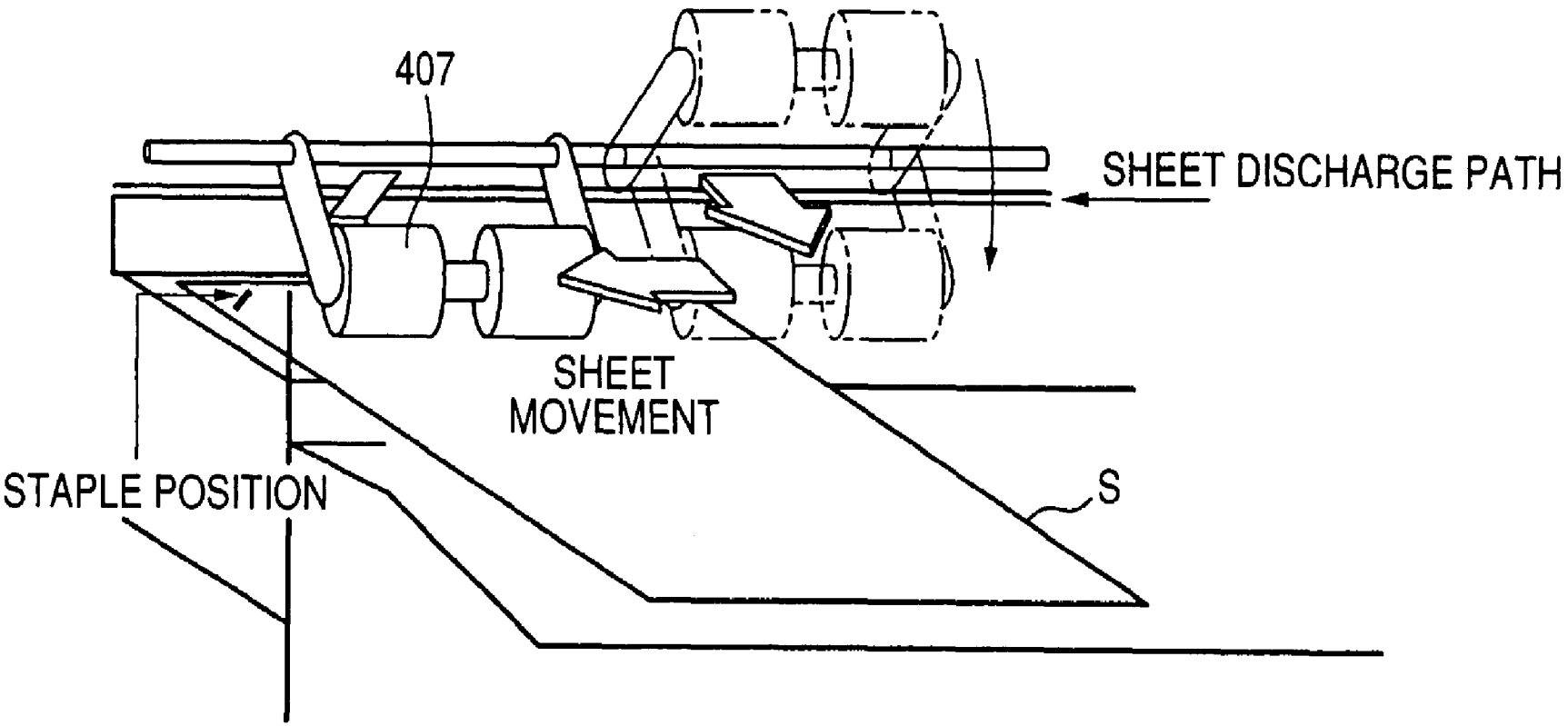
FIG. 22 is a view showing a state where sheets offset by the offset roller are stapled.

Also in the present embodiment, the control is executed by the CPU by reading a program in ROM (or RAM) corresponding to the flow charts shown in FIGS. 20 and 21, but a similar effect can be obtained by executing processes on the control program by a hardware.

In the present embodiment, there has been explained a case where controls for lifting and lowering of the stacking trays 421, 422, for stapling operation and the like are executed by the control portion (CPU 100) of the sheet treating apparatus 400, but the present invention is not limited to such case and such controls may be executed also by a control portion provided in the main body of the image forming apparatus.

Also the sheet treating apparatus 400 is to be accommodated, as explained above, without protruding from the space SP formed in the image forming apparatus, but the present invention naturally includes a case where the ends of the tacking trays 421, 422 protrude from the main body 500A of the image forming apparatus depending on the size of the treated sheet.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application Nos. 2004-123556 filed on Apr. 19, 2004, 2004-123557 filed on Apr. 19, 2004, 2004-123558 filed on Apr. 19, 2004 and 2004-123559 filed on Apr. 19, 2004, which are hereby incorporated by reference herein.

What is claimed is:

1. A sheet treating apparatus for treating sheets discharged from an image forming apparatus, and being accommodated in a space formed in an image forming apparatus, said sheet treating apparatus comprising:

plural sheet stacking devices which stack treated sheets discharged from the image forming apparatus;

a moving device which moves said plural sheet stacking devices independently of each other; and a driving unit which generates driving power for moving said plural sheet stacking devices by said moving device;

a limiting device which limits transmission of the driving power from said driving unit to said moving device when a torque in moving said sheet stacking device exceeds a predetermined torque;

a sensor device which detects that an uppermost sheet stacking device among said plural sheet stacking devices reaches an upper limit position of said sheet stacking device; and a control device which stops moving of the uppermost sheet stacking device in case said sensor device detects that the uppermost sheet stacking device reaches the upper limit position within a predetermined time after the uppermost sheet stacking device moves toward the upper limit position by said moving device, and stops moving of the uppermost sheet stacking device in case said sensor device does not detect that the uppermost sheet stacking device reaches the upper limit position even after a lapse of the predetermined time.

2. A sheet treating apparatus according to claim 1, further comprising:

a sheet treating portion for treating said sheets after the image formation; and, a discharge device which discharges the sheets treated by said sheet treating portion;

wherein the sheets treated by said sheet treating portion are selectively stacked by said discharge device on said plural sheet stacking devices.

3. A sheet treating apparatus according to claim 2, wherein a sheet discharge port which discharges the sheets from said discharge device is provided at an approximate center in a direction of height of a sheet stacking space in which said plural sheet stacking devices are provided so as to lift and lower.

4. A sheet treating apparatus according to claim 3, wherein n−1 sheet stacking devices among said plural n sheet stacking devices are rendered movable in a space above said sheet discharge port within said sheet stacking space.

5. A sheet treating apparatus according to claim 4, wherein at least a sheet stacking device, within said plural n sheet stacking devices, is made to wait under said sheet discharge port.

6. A sheet treating apparatus according to claim 4, wherein at least a sheet stacking device, within said plural n sheet stacking devices, is made to wait above said sheet discharge port.

7. A sheet treating apparatus according to claim 1 or 2, wherein said sheet stacking device is provided with a spare sheet stacking device extractable in a downstream direction in a sheet discharge direction.

8. A sheet treating apparatus according to claim 1 or 2, further comprising a sheet pressing device which presses the sheet stacked on said sheet stacking device.

9. A sheet treating apparatus according to claim 2, further comprising:

a treated sheet stacking device which stores a sheet in treating the sheet after said formation;

a sheet holding device which is provided on said discharge device and holds a sheet on said treated sheet stacking device; and a sheet movement device which moves said sheet to a position capable of a discharge to said sheet stacking device;

wherein said discharge device moves, at a sheet discharge, the treated sheet on the treated sheet stacking device to a position where said sheet can be discharged to said sheet stacking device; and said sheet holding device holds said sheet until said sheet movement device moves said sheet to a position enabling a discharge to said sheet stacking device, and, releases said sheet when said sheet movement device returns, so as to stack said sheet on said sheet stacking device.

10. A sheet treating apparatus according to claim 9, wherein:

said treated sheet stacking device includes at least one of a binding device which is capable of binding a plurality of said sheets and a sorting device which is capable of sorting said sheets in a direction perpendicular to the conveying direction of said sheets.

11. A sheet treating apparatus according to claim 1, wherein said limiting device is provided in at least an uppermost sheet stacking device among said plural sheet stacking devices.

12. An image forming apparatus comprising:

an image forming portion, and a sheet treating apparatus for treating sheets discharged from an image forming apparatus, and being accommodated in a space formed in an image forming apparatus, said sheet treating apparatus comprising:

plural sheet stacking devices which stack treated sheets discharged from the image forming apparatus;

a moving device which moves said plural sheet stacking devices independently of each other; and a driving unit which generates driving power for moving said plural sheet stacking devices by said moving device;

a limiting device which limits transmission of the driving power from said driving unit to said moving device when a torque in moving said sheet stacking device exceeds a predetermined torque;

a sensor device which detects that an uppermost sheet stacking device among said plural sheet stacking devices reaches an upper limit position of said sheet stacking device; and a control device which stops moving of the uppermost sheet stacking device in case said sensor device detects that the uppermost sheet stacking device reaches the upper limit position within a predetermined time after the uppermost sheet stacking device moves toward the upper limit position by said moving device, and stops moving of the uppermost sheet stacking device in case said sensor device does not detect that the uppermost sheet stacking device reaches the upper limit position even after a lapse of the predetermined time, said control device is provided in a main body of the image forming apparatus or in said sheet treating apparatus.

13. A sheet treating apparatus according to claim 1, further comprising:

a sensor for detecting a rotation of a driving shaft for transmitting a drive of said moving device to said sheet stacking device, wherein a drive of said moving device is stopped in case said sensor does not detect the rotation of said driving shaft after a moving of said sheet stacking device is started.

14. A sheet treating apparatus for treating sheets discharged from an image forming apparatus, and being accommodated in a space formed in an image forming apparatus, said sheet treating apparatus comprising;

a discharge device which discharges treated sheets;

plural sheet stacking devices which stack sheets discharged from the discharge device; and a moving device which moves the plural sheet stacking devices independently of each other, and moves the sheet stacking devices above a sheet discharge port for discharging the sheets;

a driving unit which generates driving power for moving said plural sheet stacking devices by said moving device;

a limiting device which limits transmission of the driving power from said driving unit to said moving device when a torque in moving said sheet stacking device exceeds a predetermined torque;

a sensor device which detects that an uppermost sheet stacking device among said plural sheet stacking devices reaches an upper limit position of said sheet stacking device; and a control device which stops moving of the uppermost sheet stacking device in case said sensor device detects that the uppermost sheet stacking device reaches the upper limit position within a predetermined time after the uppermost sheet stacking device moves toward the upper limit position by said moving device, and stops moving of the uppermost sheet stacking device in case said sensor device does not detect that the uppermost sheet stacking device reaches the upper limit position even after a lapse of the predetermined time.

15. An image forming apparatus comprising:

an image forming portion, and a sheet treating apparatus for treating sheets discharged from an image forming apparatus, and being accommodated in a space formed in an image forming a apparatus, said sheet treating apparatus comprising:

a discharge device which discharges treated sheets;

plural sheet stacking devices which stack sheets discharged from the discharge device;

a moving device which moves the plural sheet stacking devices independently of each other, and moves the sheet stacking devices above a sheet discharge port for discharging the sheets;

a driving unit which generates driving power for moving said plural sheet stacking devices by said moving device;

a limiting device which limits transmission of the driving power from said driving unit to said moving device when a torque in moving said sheet stacking device exceeds a predetermined torque a sensor device which detects that an uppermost sheet stacking device among said plural sheet stacking devices reaches an upper limit position of said sheet stacking device; and a control device which stops moving of the uppermost sheet stacking device in case said sensor device detects that the uppermost sheet stacking device reaches the upper limit position within a predetermined time after the uppermost sheet stacking device moves toward the upper limit position by said moving device, and stops moving of the uppermost sheet stacking device in case said sensor device does not detect that the uppermost sheet stacking device reaches the upper limit position even after a lapse of the predetermined time.

16. A sheet treating apparatus for treating sheets discharged from an image forming apparatus, and being accommodated in a space formed in an image forming a apparatus, said sheet treating apparatus comprising;

a discharge device which discharges treated sheets;

plural sheet stacking devices which stack sheets discharged from said discharge device;

a moving device which moves said sheet stacking devices independently of each other;

a common sheet discharge port for discharging sheets by said discharge device;

a driving unit which generates driving power for moving said plural sheet stacking devices by said moving device;

a limiting device which limits transmission of the driving power from said driving unit to said moving device when a torque in moving said sheet stacking device exceeds a predetermined torque, a sensor device which detects that an uppermost sheet stacking device among said plural sheet stacking devices reaches an upper limit position of said sheet stacking device; and a control device which stops moving of the uppermost sheet stacking device in case said sensor device detects that the uppermost sheet stacking device reaches the upper limit position within a predetermined time after the uppermost sheet stacking device moves toward the upper limit position by said moving device, and stops moving of the uppermost sheet stacking device in case said sensor device does not detect that the uppermost sheet stacking device reaches the upper limit position even after a lapse of the predetermined time, wherein said discharge device discharges the sheets from said common discharge ports selectively to said sheet stacking devices.

17. A sheet treating apparatus according to claim 16, wherein said common sheet discharge port is provided at an approximate center in a direction of height of a sheet stacking space in which said plural sheet stacking devices are provided so as to lift and lower.

18. An image forming apparatus comprising:

an image forming portion, and a sheet treating apparatus for treating sheets discharged from an image forming apparatus, and being accommodated in a space formed in an image forming a apparatus, said sheet treating apparatus comprising:

a discharge device which discharges treated sheets;

plural sheet stacking devices which stack sheets discharged from said discharge device;

a moving device which moves said plural sheet stacking devices independently of each other;

a common sheet discharge port for discharging sheets by said discharge device;

a driving unit which generates driving power for moving said plural sheet stacking devices by said moving device;

a limiting device which limits transmission of the driving power from said driving unit to said moving device when a torque in moving said sheet stacking device exceeds a predetermined torque, a sensor device which detects that an uppermost sheet stacking device among said plural sheet stacking devices reaches an upper limit position of said sheet stacking device; and a control device which stops moving of the uppermost sheet stacking device in case said sensor device detects that the uppermost sheet stacking device reaches the upper limit position within a predetermined time after the uppermost sheet stacking device moves toward the upper limit position by said moving device, and stops moving of the uppermost sheet stacking device in case said sensor device does not detect that the uppermost sheet stacking device reaches the upper limit position even after a lapse of the predetermined time, wherein said discharge device discharges the sheets from said common discharge ports selectively to said sheet stacking devices.

19. A sheet treating apparatus according to claim 1 or 2, wherein a sheet stacking surface of said sheet stacking device is substantially horizontal.

20. A sheet treating apparatus according to claim 19, further comprising sheet pressing device which presses a sheet stacked ons aid sheet stacking device.

* * * * *